US008334656B2

(12) United States Patent
Weiss

(10) Patent No.: US 8,334,656 B2
(45) Date of Patent: Dec. 18, 2012

(54) REPLACEABLE LIGHTING UNIT WITH ADJUSTABLE OUTPUT INTENSITY AND OPTIONAL CAPABILITY FOR REPORTING USAGE INFORMATION, AND METHOD OF OPERATING SAME

(75) Inventor: William J. Weiss, Boca Raton, FL (US)

(73) Assignee: MSI, LLC, Deerfield Beach, FL (US)

( * ) Notice: Subject to any disclaimer, the term of this patent is extended or adjusted under 35 U.S.C. 154(b) by 257 days.

(21) Appl. No.: 12/611,703

(22) Filed: Nov. 3, 2009

(65) Prior Publication Data

US 2011/0101868 A1 May 5, 2011

(51) Int. Cl.
*H01J 7/44* (2006.01)

(52) U.S. Cl. ..... 315/33; 315/291; 315/360

(58) Field of Classification Search ..... 315/33, 315/291, 360
See application file for complete search history.

(56) References Cited

U.S. PATENT DOCUMENTS

| | | | | |
|---|---|---|---|---|
| 4,497,016 | A | 1/1985 | Sachse | |
| D284,792 | S | 7/1986 | Thiry et al. | |
| D306,765 | S | 3/1990 | Pavelin | |
| D309,503 | S | 7/1990 | Benson et al. | |
| D321,762 | S | 11/1991 | Mujahid et al. | |
| D327,132 | S | 6/1992 | Schuster | |
| 5,633,629 | A | 5/1997 | Hochstein | |
| 5,661,645 | A | 8/1997 | Hochstein | |
| 5,757,110 | A | 5/1998 | Motiduki et al. | |
| D398,407 | S | 9/1998 | O'Connell et al. | |
| D435,577 | S | 12/2000 | McBride | |
| 6,495,964 | B1 * | 12/2002 | Muthu et al. | 315/149 |
| 6,511,209 | B1 | 1/2003 | Chiang | |
| D469,890 | S | 2/2003 | Bobel | |
| D470,604 | S | 2/2003 | Bobel | |

(Continued)

FOREIGN PATENT DOCUMENTS

EP 1098550 B1 4/2005

(Continued)

OTHER PUBLICATIONS

International Search Report and Written Opinion dated Jul. 26, 2011 issued by the Korean Intellectual Property Office as International Searching Authority in connection with counterpart International Application No. PCT/US2010/002864 (7 pages).

*Primary Examiner* — Thuy Vinh Tran
(74) *Attorney, Agent, or Firm* — Daniel C. Crilly; GrayRobinson, P.A.

(57) ABSTRACT

A lighting unit includes a power supply, a light source, a controller, and an output intensity adjustment mechanism. The adjustment mechanism is configured to allow a user to set an output intensity of a plurality of non-zero intensities generatable by the light source. The controller is operable to control a supply of electrical power from the power supply to the light source such that the light source illuminates in accordance with the intensity set by the user. The lighting unit is also operable to optionally report usage information for the lighting unit (e.g., cumulative on time) using the light source to produce a visually undetectable information signal. The controller is further optionally operable to adjust (e.g., increase) the electrical power supplied to the light source when the cumulative on time for the light source corresponds to a point on a lumen depreciation curve indicating a reduction in light source intensity.

36 Claims, 15 Drawing Sheets

U.S. PATENT DOCUMENTS

| | | | |
|---|---|---|---|
| D470,606 | S | 2/2003 | Bobel |
| 6,548,967 | B1 | 4/2003 | Dowling et al. |
| 6,739,737 | B2 | 5/2004 | Yu |
| D498,007 | S | 11/2004 | Bobel |
| D519,455 | S | 4/2006 | Tufano et al. |
| 7,038,399 | B2 | 5/2006 | Lys et al. |
| D532,532 | S | 11/2006 | Maxik |
| D542,425 | S | 5/2007 | Wang |
| D544,110 | S | 6/2007 | Hooker et al. |
| D547,886 | S | 7/2007 | Foo |
| D561,917 | S | 2/2008 | Tsao |
| D581,555 | S | 11/2008 | To et al. |
| D593,223 | S | 5/2009 | Komar |
| D593,706 | S | 6/2009 | Zayas et al. |
| 7,557,521 | B2 | 7/2009 | Lys |
| D598,143 | S | 8/2009 | Gerritsen |
| D601,721 | S | 10/2009 | Foo |
| D602,178 | S | 10/2009 | Foo |
| D613,434 | S | 4/2010 | Weiss |
| D615,698 | S | 5/2010 | Weiss |
| 2008/0111503 | A1 | 5/2008 | Ess et al. |
| 2008/0228508 | A1* | 9/2008 | Lyons et al. ..... 705/1 |
| 2010/0090613 | A1* | 4/2010 | Spartano ..... 315/287 |

FOREIGN PATENT DOCUMENTS

| | | | |
|---|---|---|---|
| JP | 10039836 | A | 2/1998 |
| JP | 2009004130 | A | 1/2009 |

* cited by examiner

REPLACEABLE LIGHTING UNIT WITH ADJUSTABLE OUTPUT INTENSITY AND OPTIONAL CAPABILITY FOR REPORTING USAGE INFORMATION, AND METHOD OF OPERATING SAME

BACKGROUND

1. Field of the Invention

The present invention relates generally to the field of lighting and, more particularly, to a replaceable lighting unit with adjustable output intensity (lumens) and optional capability for reporting usage information (e.g., time in use), and associated method of operation.

2. Description of Related Art

Light emitting diodes (LEDs) are highly efficient electrical light sources and are being utilized increasingly for indoor, outdoor and vehicular lighting purposes. Typically, several LEDs are incorporated into a lighting unit to produce a predetermined light output. The number and type of LEDs, as well as the design of the lens element that directs or concentrates the light produced thereby, determines the light output power and the power consumed by the lighting unit.

LEDs offer many advantages over incandescent, halogen and fluorescent lighting units. LEDs are highly shock resistant and, therefore, do not shatter when subjected to mechanical or thermal shock (e.g., when dropped). LEDs also possess operating life times that are substantially longer than their incandescent, halogen, and fluorescent counterparts. For example, in some cases, the operating life of an LED lighting unit may exceed 100,000 hours, as compared to the typical 1,000-2,000 hours for incandescent bulbs and 5,000-10,000 hours for fluorescent bulbs.

In certain applications, such as in large department stores, warehouses, and the like, a large number of lighting units are utilized to illuminate the space and/or to direct light to certain locations within the space. The low power consumption and extended useful life of LED lights makes them ideally suited for such lighting tasks.

Lighting units made with LEDs are more expensive than comparable incandescent, halogen or fluorescent bulbs, but consume far less power and last much longer. Although the low power consumption and extended life of LED lights make them the superior choice in lighting options, the initial capital outlay to install LED lights in large numbers is quite costly.

Moreover, in certain lighting arrangements, such as those used in department stores where displays are rearranged or reconfigured from time to time, users of the lighting arrangements may desire to vary the intensity of some or all of the lights in a given space. The high cost of LED lights may make the purchase of multiple, fixed intensity LED lights for each fixture impractical even though such lights are more energy efficient. Presently, there are no self-contained, adjustable intensity, replaceable lighting units available on the market, regardless of whether the light source is a set of LEDs or a more conventional incandescent, halogen, or fluorescent bulb. Rather, the intensity of a light bulb or a set of light bulbs in a light fixture may be controlled remotely through use of a specialized wall switch (e.g., a dimmer).

Additionally, LEDs operate at relatively high temperatures. Therefore, a heat dissipation structure, such as a heat sink, is typically employed to reduce the operating temperature of lighting units that employ LEDs. Lighting units employing LEDs sometimes realize temperatures that are so high that solder joints break or solder melts, causing previously soldered wires to be released and potentially exposed.

In addition, LED lighting units incorporate electronic components and circuit pathways, such as wires and printed circuit board traces. Standard certification bodies, such as Underwriters' Laboratories (UL), require that such components and circuitry be shielded and rendered inaccessible by a fire retardant material so as to avoid injury or fire. In many of today's electronic products, the materials housing the LED circuits are thermoplastics. To categorize the fire retardant capabilities of thermoplastic materials, UL and other certification companies establish fire rating certifications. For example, depending on a thermoplastic material's performance in UL's vertical burn test, UL classifies the material into one of five fire classes: UL 94, V0, V1, V2 or 5 V (or V5).

A thermoplastic material is classified in fire class UL 94 V0 if the following criteria are met: For a set of five samples measuring 127 mm×12.7 mm×3.16 mm, all samples can continue burning after application of a flame twice for 10 seconds. The sum of the combustion times after 10 flame applications to five samples must not be longer than 50 seconds. None of the samples must drip flaming particles, burn completely or burn with glowing combustion for longer than 30 seconds.

For classification in fire class UL 94 V1, the combustion times must not be longer than 30 seconds and the sum of the combustion times for 10 flame applications to five samples must not be longer than 250 seconds. Glowing combustion must never last longer than 60 seconds. The other criteria are identical to those mentioned above for fire class UL 94 V0. A material is classified in fire class UL 94 V2 when the above criteria for classification as UL 94 V1 are fulfilled and dripping of flaming particles occurs.

A plastic material is classified in fire class UL 94 V5 if the following criteria are met: The combustion time or glowing combustion time of the samples must not exceed 60 seconds after the final flame application. A flame 127 mm high and having an inner blue cone 38 mm high is applied to each sample five times for five seconds. Two successive flame applications are separated in each case by an interval of five seconds. Neither dripping of flaming or non-flaming particles nor complete combustion may occur.

When given, a UL 94-V5 rating indicates that the plastic materials used to house the lighting product have been tested in accordance with the UL vertical burn test criteria and have met the UL 94-V5 criteria based on a specified thickness of material. Thus, when a non-isolated power supply is used to supply power to the electrical components of the lighting device, a UL 94-V5 fire rating can only be achieved when the electrical wiring remains within a plastic enclosure that has a UL 94-V5 fire rating.

Further, due to the substantial operating lifetimes of LEDs, users of LED lighting units may not readily be able to anticipate when such lighting units will need to be replaced. For instance, the personnel in charge of maintaining the lighting units may turnover one or more times during the life of an LED lighting unit, potentially resulting in a loss of information regarding the amount of time the unit has been in use unless such personnel are precise in maintaining written use records. Such a loss of information may result in an unexpected reduction in intensity at an inopportune time. Additionally, turnover in personnel and the associated interruption in record-keeping may result in a loss of warranty and other usage information for each LED lighting unit.

Therefore, a need exists for a replaceable lighting unit that provides user-settable output intensity. Such a lighting unit that optionally shields electrical wiring to meet the UL 94-V5 fire rating and reports usage information would be a further improvement over the prior art.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
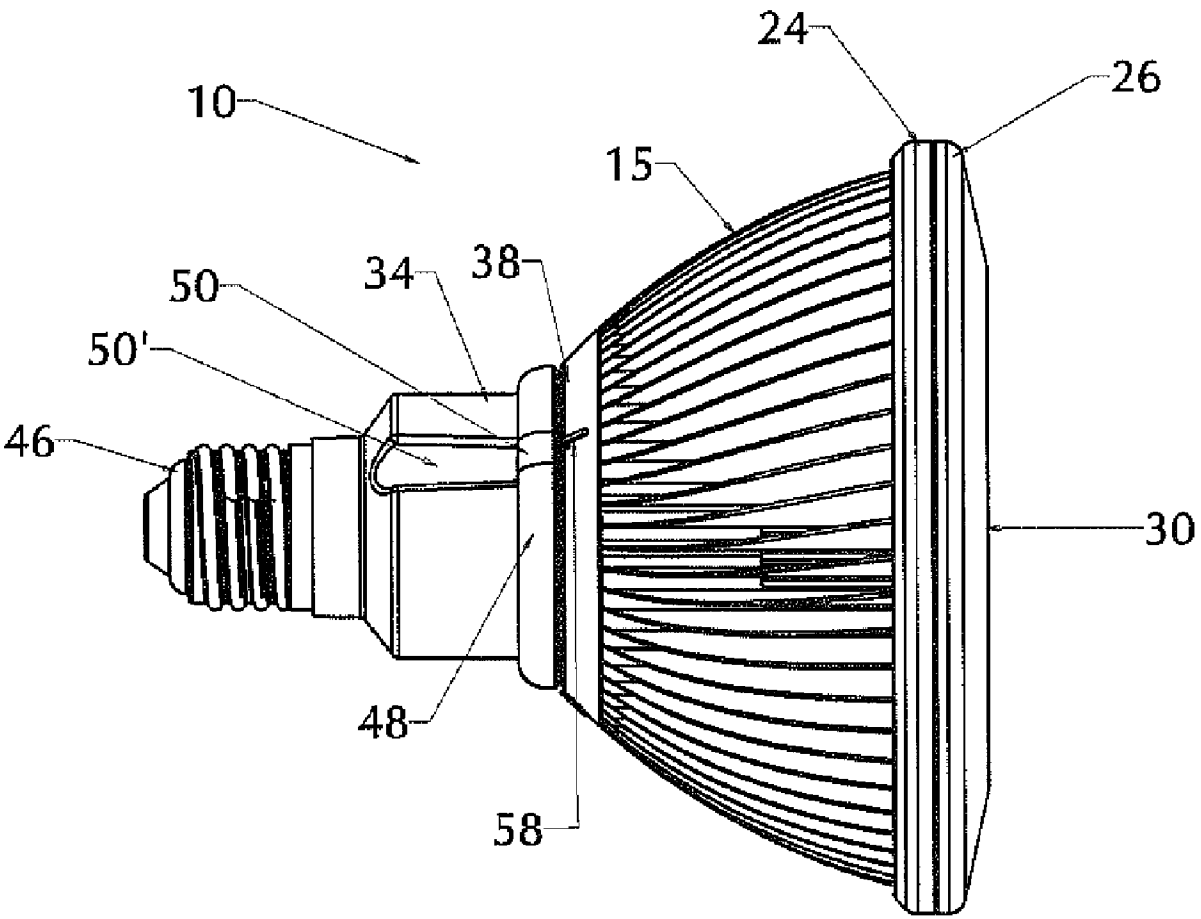
FIG. 1 is a right side, elevational view of a lighting unit in accordance with one embodiment of the present invention.

Skilled artisans will appreciate that elements in the figures are illustrated for simplicity and clarity and have not necessarily been drawn to scale. For example, the dimensions of some of the elements in the figures may be exaggerated alone or relative to other elements to help improve the understanding of the various embodiments of the present invention.

DETAILED DESCRIPTION

Generally, the present invention encompasses a self-contained, replaceable lighting unit with user-settable output intensity designed for use in a light fixture, and associated methods of operation to optically report usage information and maintain output intensity notwithstanding lumen depreciation over time. In accordance with one embodiment, the lighting unit includes, inter alia, a power supply, a light source (e.g., one or more light emitting diodes (LEDs)), an output intensity adjustment mechanism, and a controller. The output intensity adjustment mechanism is configured to allow a user to set one of multiple, non-zero output intensities generatable by the light source. The controller is operable to control a supply of electrical power from the power supply to the light source such that the light source illuminates in accordance with the output intensity set by the user.

In an alternative embodiment in which the light source includes at least one LED and each LED includes a lens, the lighting unit may further include at least one light-concentrating member, at least a first printed circuit board supporting at least the controller, a second printed circuit board supporting the LED(s) and being separated from the first printed circuit board, a set of wires, and a non-metallic shield member. Each light-concentrating member is positioned in substantial registry with a respective LED and defines a receiving recess or indentation. The receiving recess is configured to receive the lens of an LED. The light-concentrating member may be generally conical in shape with the receiving recess located at the vertex of the member. The inner surface of the conical light-concentrating member may include one or more ridges or facets designed to assist in reflecting the light generated by the LED such that the light exits the base of the conical member in substantially parallel rays. When multiple light-concentrating members are present, such members may be configured or collected into a single light concentrating lens element that functions as the overall lens of the lighting unit.

In this embodiment, the second printed circuit board defines a wire pass-through aperture and includes a set of solder pads. The set of wires pass through the wire pass-through aperture of the second printed circuit board and are soldered to the solder pads to electrically connect the first printed circuit board and the set of solder pads. The solder pads are additionally electrically coupled to the LED(s). The shield member is secured to the second printed circuit board (e.g., via one or more fasteners, such as screws) and positioned between the second printed circuit board and the light-concentrating member(s), such that a cavity defined by the shield member encloses the set of wires and the set of solder pads. In one embodiment, the shield member has a UL 94-V5 fire rating. In another embodiment, the shield member further defines at least one LED lens aperture and each LED lens aperture is substantially in registry with a corresponding receiving recess of the light-concentrating member(s) such that the lens(es) of the LED(s) passes through the lens aperture(s) of the shield member and into the receiving recess(es) of the light-concentrating member(s). In such a case, the shield member functions to isolate the current-carrying components of the lighting unit from the lens of the lighting unit, which may consist of the light-concentrating members as combined into a single lens element. When the shield member and the other components of the lighting unit that house current-carrying electrical components have a UL 94-V5 fire rating, the entire lighting unit may have a UL 94-V5 fire rating.

In yet a further embodiment, the lighting unit may include a timer and a memory, each of which is coupled to the controller. The timer and the memory may be integrated into the controller or be separate electronic components coupled to the controller via printed circuit board traces and/or other electronic components (e.g., wires, connectors, resistors, capacitors, diodes, transistors, etc.). The timer is operable to determine an amount of time that the light source has been illuminated. The memory is operable to store a value representing a cumulative amount of time that the light source has been illuminated and at least one lumen depreciation curve indicating an estimated variation in output intensity of the light source over time. When differing LEDs are used collectively as the light source, the memory may store multiple lumen depreciation curves for the varying LEDs. In this embodiment, the controller is further operable to: (i) adjust the supply of electrical power from the power supply to the light source based on the stored value representing the cumulative amount of time that the light source has been illuminated and the stored lumen depreciation curve(s). For example, when the stored value representing the cumulative amount of time that the light source has been illuminated corresponds to a point on the stored lumen depreciation curve indicating that an output intensity of the light source has decreased, the controller may increase the supply of electrical power to the light source in an attempt to maintain the original output intensity of the light source. Alternatively, the controller may decrease or even cease the supply of electrical power to the light source to provide a readily discernible indication to the user that light source efficiency has been substantially reduced.

In yet another alternative embodiment in which the light source includes a plurality of LEDs, the lighting unit may further include a light concentrating lens element defining a plurality of generally conical light-concentrating members. Each light-concentrating member defines a base end and a vertex end, and includes a body connecting the base end to the vertex end. The light-concentrating members are arranged such that their base ends occupy a predetermined portion of a circular area defined by a diameter of the light concentrating lens element. Additionally, each light-concentrating member is positioned in substantial registry with a corresponding LED and defines a receiving recess (e.g., at the vertex end of the cone). The receiving recess receives a lens of the corresponding LED when the LED is in substantial registry with the receiving recess. Further, the light-concentrating members are configured such that light output produced by the light concentrating lens element responsive to illumination of the LEDs produces (a) at least a first output intensity over a first horizontal angular range between about zero degrees and about ten degrees and a first vertical angular range between about zero degrees and about ten degrees relative to a normal of the light concentrating lens element and (b) at least a second, non-zero output intensity that is less than the first output intensity over a second horizontal angular range and a second vertical angular range relative to the normal of the light concentrating lens element. The second horizontal angular range is greater than the first horizontal angular range and does not overlap the first horizontal angular range. Similarly, the second vertical angular range is greater than the first vertical angular range and does not overlap the first vertical angular range. Each light-concentrating member is formed of a material having a first refractive index that is greater than a second refractive index of a material substantially surrounding the body of the light-concentrating member such that light emanating from an associated LED propagates through the light-concentrating member by virtue of total internal reflection.

In a further alternative embodiment in which the lighting unit includes a light concentrating lens element defining a plurality of light-concentrating members, the diameter of the light concentrating lens element is between about 70 millimeters and about 80 millimeters, and the light concentrating lens element has a diameter-to-height ratio of about 5.33:1. Alternatively or additionally, the quantity and arrangement of the LEDs may be selected such that a main output intensity of at least about 150 candela is produced over a horizontal angular range of about 8 degrees from about −4 degrees to about +4 degrees relative to normal and over a vertical angular range of about 8 degrees from about −4 degrees to about +4 degrees relative to normal. Such an arrangement and quantity of LEDs may further produce a secondary output intensity of between about 100 candela and about 150 candela over a horizontal angular range of about 44 degrees from about −4 degrees to about −50 degrees and from about +4 degrees to about +50 degrees relative to normal and over a vertical angular range of about 44 degrees from about −4 degrees to about −50 degrees and from about +4 degrees to about +50 degrees relative to normal. In one embodiment, the quantity of LEDs is nine, although those of ordinary skill in the art will readily recognize that other quantities of LEDs may be alternatively employed.

In a further alternative embodiment, the lighting unit's output intensity adjustment mechanism may include at least one magnetic field source and at least one magnetic field detector. For example, the magnetic field source may be a magnet or any other device (e.g., antenna) or circuit that generates a magnetic field, and the magnetic field detector may be a Hall effect sensor or any other device (e.g., antenna) or circuit operable to detect magnetic fields. In this embodiment, the controller is operably coupled to the magnetic field detector(s) and is operable to control the supply of electrical power from the power supply to the light source such that the light source illuminates in accordance with the output intensity set by the user based on detection of at least one magnetic field by the magnetic field detector(s). Alternatively, the output intensity adjustment mechanism may be formed from other source/detector combinations or may just include a detection mechanism. For example, the output intensity adjustment mechanism may include an optical source (e.g., a single, battery-operated LED) and an optical detector, an electromagnetic source (e.g., a battery-operated, very low power, continuous wave signal generator operating at a predetermined frequency) and an electromagnetic detector, or an optical detector (e.g., where presence of light would indicate one adjustment setting and lack of light would indicate another adjustment setting). Further, when the light source is produced using multiple light-generating devices (e.g., LEDs or lamps), each light-generating device may have its own microcontroller that sets the output intensity of the light-generating device based on signaling from the main controller.

In one particular embodiment in which the output intensity adjustment mechanism includes at least one magnet and at least one magnetic field detector, the lighting unit further includes at least one printed circuit board, a hollow, generally cylindrical base member, a support plate (which may form part of a hub of a heat sink positioned between the base member and the light source), at least one magnetizable fastener (e.g., metal screw), and a generally circular, preferably non-metallic (e.g., plastic) ring member. The printed circuit board or boards support the power supply, the controller, and the magnetic field detector(s). The base member defines, in an outer surface thereof, at least one channel extending along at least a portion of a length of the base member. Each channel terminates at one end in a wall defining a wall aperture. The magnetizable fastener is insertable through the wall aperture for fastening at least the base member to the support plate. The ring member includes at least one socket projecting toward a center of a circle defined by the ring member. One or more of the sockets is configured to fit within a channel of the base member and defines a recess for retaining a magnet. In this embodiment, each magnetic field detector is positioned on the printed circuit board so as to be proximate a respective fastener (e.g., within a distance of the fastener sufficient to enable the magnetic field detector to detect a magnetic field surrounding the fastener when the fastener is magnetized) when the fastener is fastened to the support plate. The ring member may be positioned (e.g., rotated) about the base member such that each socket resides within a respective channel of the base member and is in contact with the fastener. The magnets in some or all of the sockets magnetize the fasteners in which they are in contact to produce one or more magnetic fields detectable by the magnetic field detector(s). The magnets may also serve to hold the ring member in place (e.g., by magnetically attracting or attaching to the metallic fasteners) regardless of the orientation of the lighting unit. In another embodiment, the magnets may contact magnetizable members, such as metallic rods, instead of the fasteners to produce the magnetic fields detectable by the magnetic field detectors.

Magnetic field detectors may be positioned proximate some or all of the fasteners securing the base member to the support plate. In this embodiment, the quantity of magnets and magnetic field detectors determine the quantity of possible output intensity levels for the light source and the lighting unit. For example, the use of one magnet and two magnetic field detectors provides for three possible output intensity levels as controlled by the controller (e.g., a first intensity level (default level) when neither magnetic field detector detects a magnetic field, a second intensity level when a first one of the magnetic field detectors detects a magnetic field, and a third intensity level when a second one of the magnetic field detectors detects a magnetic field). Those of ordinary skill in the art will readily appreciate that the quantity of possible output intensity levels may be increased by increasing the combined quantity of magnetic field sources (e.g., magnets) and magnetic field detectors (e.g., Hall effect sensors).

In a further alternative embodiment, the lighting unit may also include a timer and a memory coupled to the controller. The timer and the memory are similar to the timer and memory discussed above in that the timer is operable to determine an amount of time that the light source has been illuminated, and the memory is operable to store a value representing a cumulative amount of time that the light source has been illuminated. However, in this case, the controller is further operable to update the value stored in the memory based on the amount of time determined by the timer and determine whether a reporting time interval has arrived. The controller may determine whether a reporting time interval has arrived based on whether the value stored in the memory is greater than or equal to a threshold (e.g., the controller may determine the arrival of a reporting interval when the quantity of time the light source has been turned on reaches a predetermined threshold (e.g., 1000 hours) or reaches a time at which light source intensity is expected to decrease based on a stored lumen depreciation curve). Alternatively, the controller may determine reporting time intervals on a periodic or other intermittent basis (e.g., once every 24 hours, every 10 seconds within two hours of installation and then once a day at a time (e.g., at night) when a business in which the lighting unit has been installed is closed, etc.). When a reporting time interval has arrived, the controller is further operable to modulate or pulse the supply of electrical power from the power supply to the light source so as to cause the light source to optically communicate an information signal therefrom. The information signal is preferably visually undetectable by the user and, in one embodiment, includes the value stored in the memory. Alternatively, the information signal may include other usage information, such as warranty data, quantity of times the lighting unit was turned on and off (where the lighting unit includes a counter and detects activation and deactivation of the power supply), maximum heat sink temperature (where the lighting unit includes a thermistor coupled to a heat sink), product test data results, serial number, firmware version, or date of manufacture, just to name a few. Still further, the information signal may be, at least occasionally, visibly detectable (e.g., light blinking, such as two blinks indicate 100 hours of use).

In a further embodiment, the present invention includes a method for a lighting unit to optically report usage information from a light source of the lighting unit. In accordance with the method, a controller of the lighting unit or some other device (either local to the lighting unit or remote therefrom) determines a cumulative amount of time that the light source has been illuminated and whether a reporting time interval has arrived. When a reporting time interval has arrived, the light source is used to generate an optical, visually undetectable information signal that includes a value representing the cumulative amount of time that the light source has been illuminated. For example, in one embodiment, the lighting unit controller may control the frequency or frequencies at which the light source is turned on and off or pulsed to be such as to communicate the information signal at a rate that is visually undetectable by a user of the lighting unit. In such a manner, the lighting unit may report usage information, such as the amount of time the lighting unit has been turned on (on time), warranty information, and other usage information to the user of the lighting unit or others in possession of an appropriate optical detector.

In one embodiment, the determination as to whether a reporting time interval has arrived may be based on whether the cumulative amount of time that the light source has been illuminated is greater than or equal to a threshold. The threshold may be pre-established and fixed (e.g., 1000 hours of on time) or may be determined based on stored data related to the light source, such as a time at which light source intensity is expected to decrease based on a stored lumen depreciation curve for the light source. Alternatively, the determination of as to whether a reporting time interval has arrived may be based on a periodicity of reporting intervals (e.g., once every 24 hours) or other user-settable criteria. In such a case, the determination of whether a reporting time interval has arrived may include a determination as to whether a predetermined amount of time has passed since a previous reporting time interval.

In yet another embodiment, the present invention includes a method for maintaining an output intensity for a lighting unit utilizing a light source, such as plurality of LEDs. According to this embodiment, at least one lumen depreciation curve for the light source is stored in a memory, which may be contained within the lighting unit or be remote therefrom. The lumen depreciation curve (or curves where, for example, multiple LEDs are used having differing optical characteristics) indicates an estimated variation in output intensity of the light source over time. A controller of the lighting unit or some other device (either local to the lighting unit or remote therefrom) determines a cumulative amount of time that the light source has been illuminated and adjusts a supply of electrical power to the light source based on the cumulative amount of time that the light source has been illuminated and the lumen depreciation curve. For example, when the stored value representing the cumulative amount of time that the light source has been illuminated corresponds to a point on the lumen depreciation curve indicating that an output intensity of the light source has decreased for a particular supply of electrical power to the light source, the controller may increase the supply of electrical power to the light source in an attempt to maintain the original output intensity of the light source.

By providing a lighting unit and method of operation in this manner, the present invention enables a user to manually set or adjust the output intensity of the lighting unit without requiring access to any of the internal electrical components of the lighting unit. Additionally, when the optional shield member is used to isolate the current carrying portions of the light source from the non-current carrying portions and, thereby effectively enclose the current carrying portions of the lighting unit within a multi-piece housing, the lighting unit of the present invention may meet the fire rating requirements of the UL 94-V5 standard when the shield member and the other portions of the multi-piece housing are manufactured from materials, such as POLYLAC PA-765 Acrylonitrile Butadiene Styrene (ABS) thermoplastic material available from Entech Polymers, LLC of Orlando, Fla., that are also UL 94-V5 compliant. Further, by monitoring the amount of time the lighting unit is powered on and determining the expected output intensity of the light source based on a lumen depreciation curve for the light source, the present invention allows the electrical power supplied to the light source to be adjusted to maintain the original output intensity for most, if not all, of the operating life of the light source. Still further, by appropriately modulating or pulsing the electrical power supplied to the light source such that the light source turns on and off at a frequency undetectable by the human eye, the present invention permits a visually undetectable information signal to be communicated from the primary light source of the lighting unit so as to permit usage information for the lighting unit to be reported at desired reporting intervals.

Figure 11:
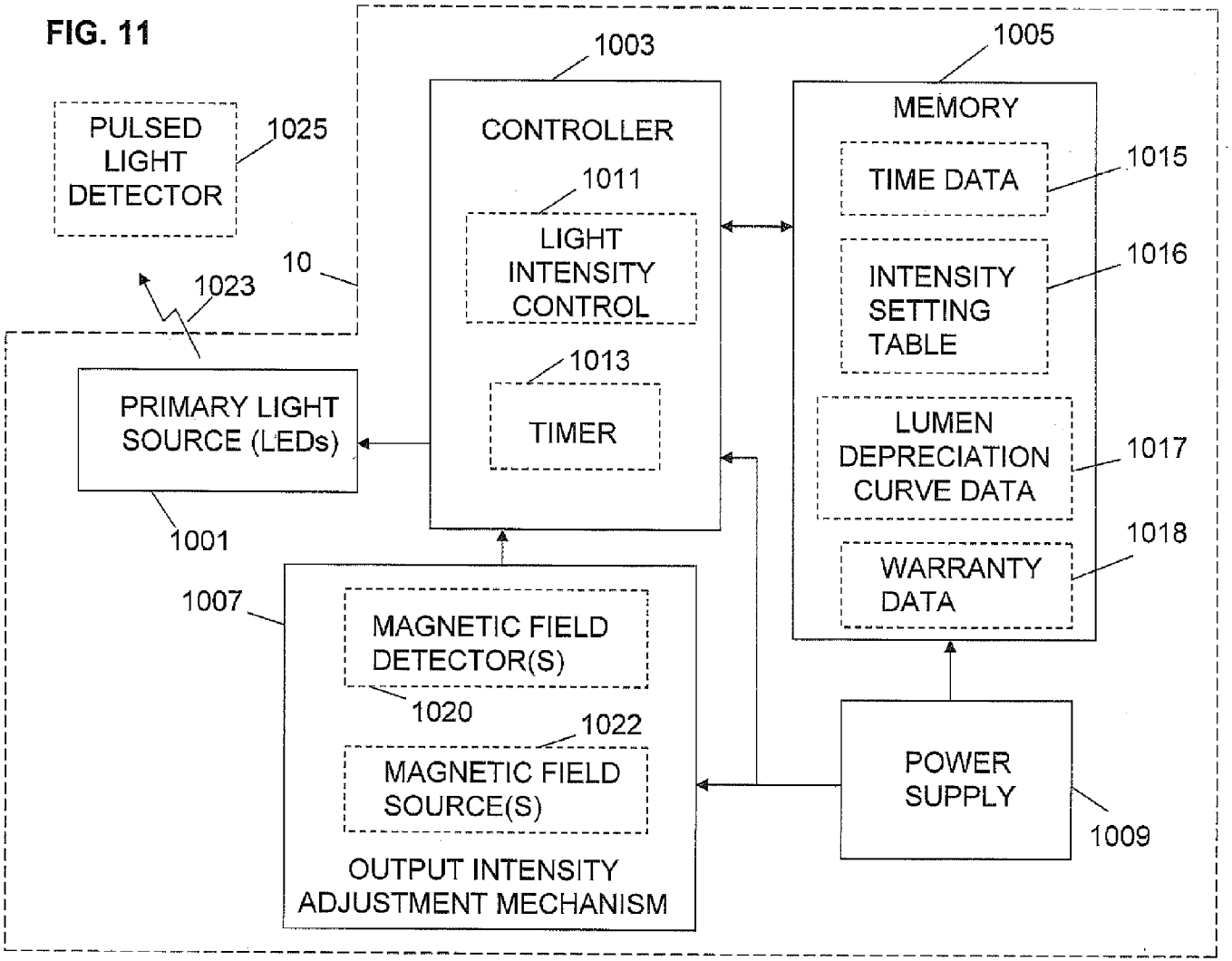
FIG. 11 is an electrical block diagram of a lighting unit with adjustable output intensity and optional optical reporting capability in accordance with an exemplary embodiment of the present invention.
Figure 12:
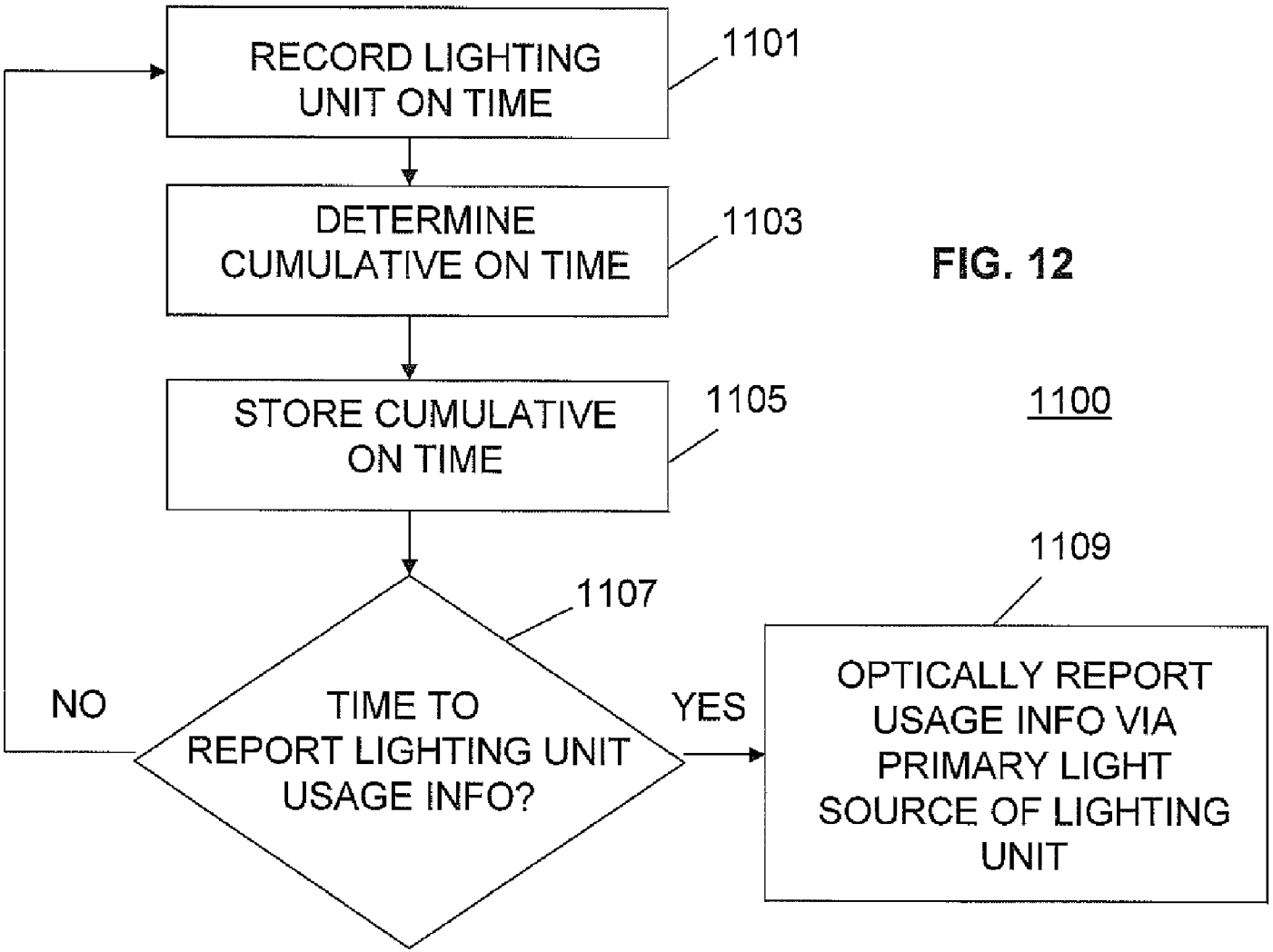
FIG. 12 is a flow diagram of steps executed by a lighting unit controller to report usage information optically via a primary light source of the lighting unit in accordance with an alternative embodiment of the present invention.
Figure 13:
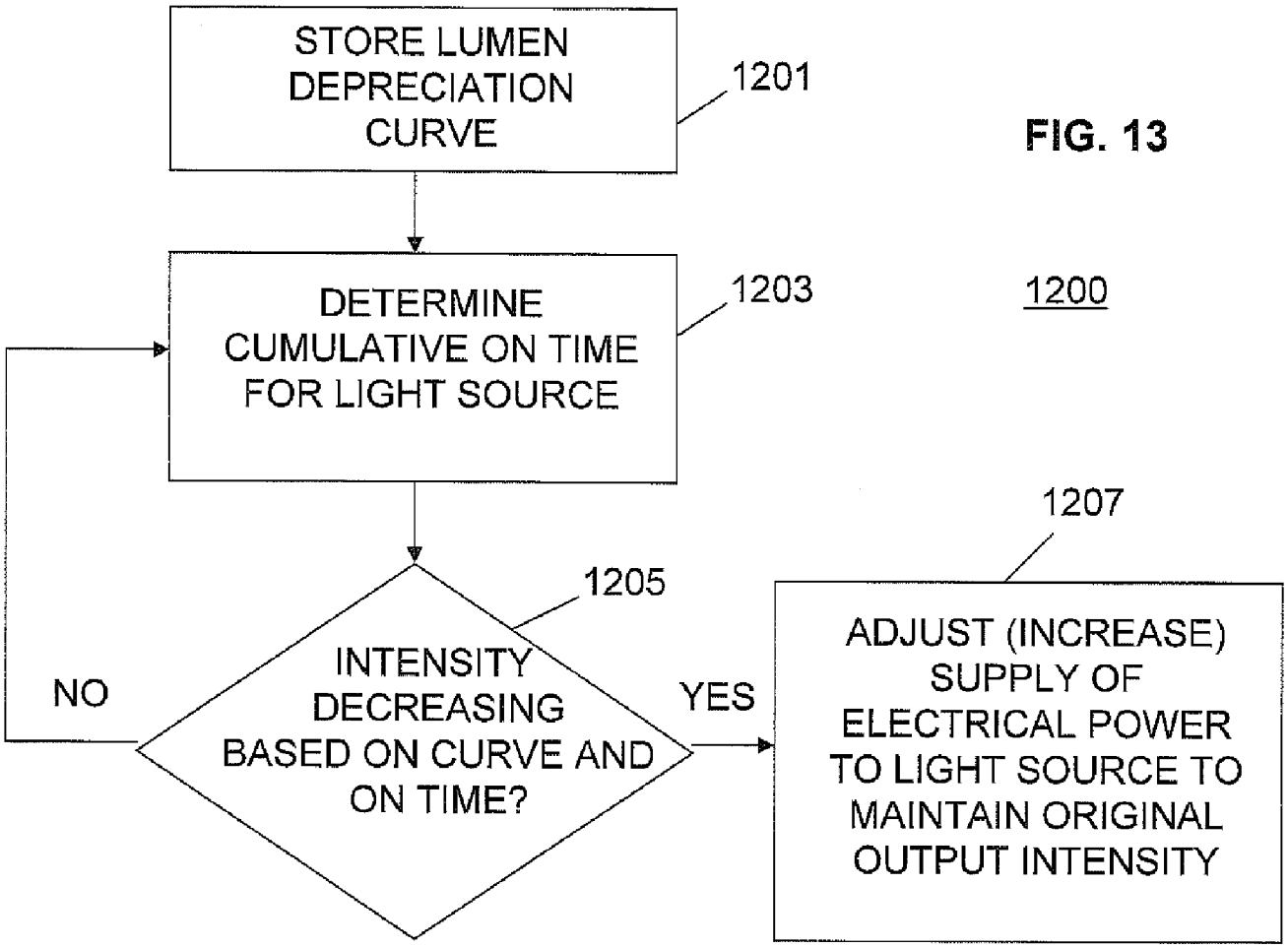
FIG. 13 is a flow diagram of steps executed by a lighting unit controller to automatically adjust electrical power supplied to LEDs of the lighting unit to maintain a predetermined output intensity notwithstanding expected lumen depreciation in accordance with an alternative embodiment of the present invention.

Embodiments of the present invention can be more readily understood with reference to FIGS. 1-13, in which like reference numerals designate like items. FIGS. 1-4, 9, and 10A-10C focus primarily on illustrating the mechanical features of a lighting unit 10 in accordance with one embodiment of the present invention. FIG. 11 focuses primarily on illustrating, in block diagram form, the electrical features of a lighting unit in accordance with embodiments of the present invention, which lighting unit may be the lighting unit 10 of FIG. 1. FIGS. 5-8 illustrate an exemplary light concentrating lens element suitable for use in a lighting unit in accordance with the present invention. Finally, FIGS. 12 and 13 illustrate logic flows associated with implementing particular methods of operating a lighting unit in accordance with embodiments of the present invention.

As shown in FIGS. 1-4, 9, and 11, the lighting unit 10 includes, inter alia, a light source 1001, a controller 1003, an output intensity adjustment mechanism 1007, and a power supply 1009. The lighting unit 10 may optionally include memory 1005 for storing a variety of information and data, such as programs executable by the controller 1003 and other information as described in more detail below. The memory 1005, which may be a separate element as depicted in FIG. 10 and/or may be integrated into the controller 1003, can include random access memory (RAM), read-only memory (ROM), FLASH memory, electrically erasable programmable read-only memory (EEPROM), removable memory, and/or various other forms of memory as are well known in the art. It will be appreciated by one of ordinary skill in the art that the various memory components can each be a group of separately located memory areas in the overall or aggregate lighting unit memory and that the lighting unit memory may include one or more individual memory elements.

Figure 9:
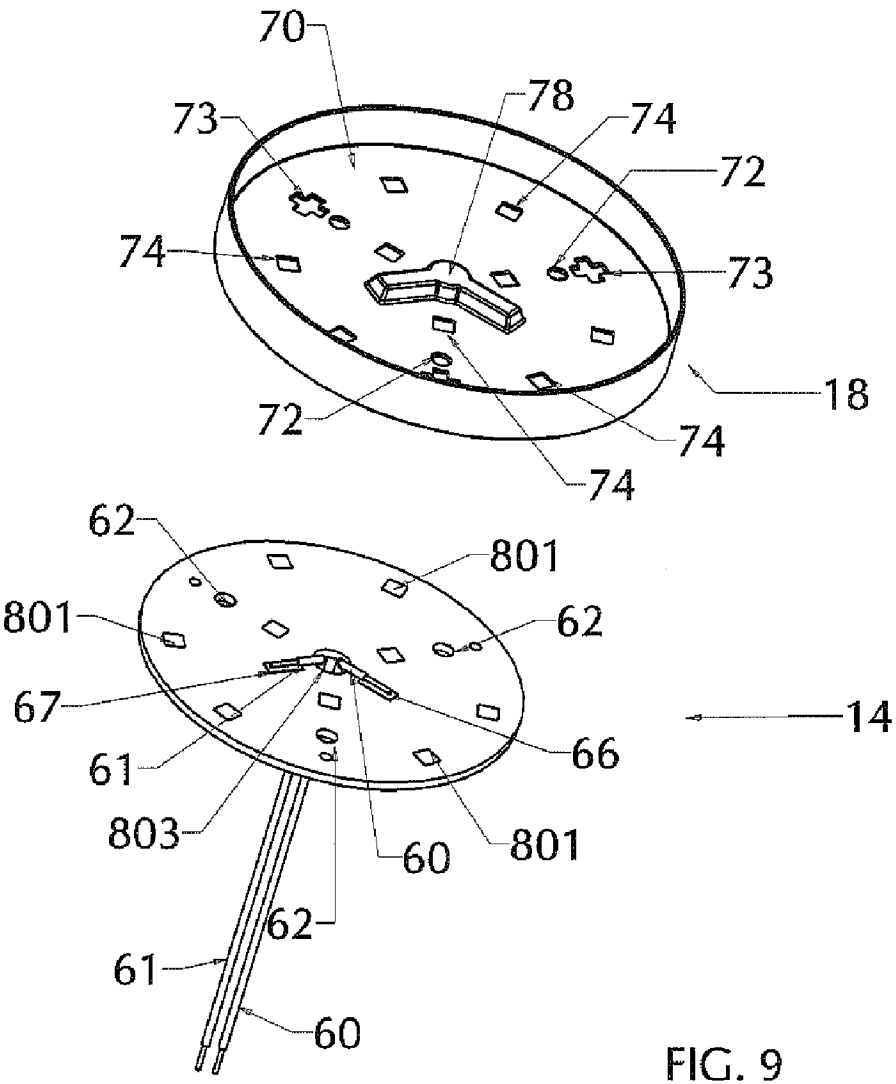
FIG. 9 is a perspective exploded view of a shield member and a printed circuit board supporting a set of LEDs in accordance with an alternative embodiment of the present invention.

The light source 1001 preferably includes one or more light emitting diodes (LEDs) 801 (nine shown in FIG. 9). Alternatively or additionally, the light source 1001 may include one or more other light-generating sources, such as miniature incandescent lamps. The light source 1001 receives electrical power from the power supply 1009 under the control of the controller 1003.

The controller 1003 may be a microprocessor or microcontroller and operates in accordance with one or more stored programs. The program or programs may be stored in internal memory of the controller 1003 or in memory 1005 electrically coupled to the controller 1003. One of the stored programs is preferably a light intensity control program 1011 that enables the controller to control a supply of power from the power supply 1009 to the light source 1001 based on a desired intensity level set by the output intensity adjustment mechanism 1007. In an alternative embodiment, the stored programs may include programs for using the light source 1001 to report usage information for the lighting unit 10 and for maintaining output intensity level for the lighting unit 10 notwithstanding an expected decrease in intensity of the light source 1001 over time. The controller 1003 may optionally include a timer 1013 or be electrically coupled to an external timer (which may be resident within the lighting unit 10 or external thereto). When included, the timer 1013 is used to track or record the amount of time that the light source 1001 is turned on or illuminated by the controller 1003 during an "on" time period. The amount of time recorded is provided by the controller 1003 to the memory 1005 for storage as time data 1015. The time data 1015 is preferably updated after every "on" time period such that the time data 1015 stored in the memory 1005 reflects the cumulative amount of time the light source 1001 has been illuminated.

In one embodiment, the output intensity adjustment mechanism 1007 includes one or more magnetic field sources 1022 and one or more magnetic field detectors 1020. For example, each magnetic field source 1022 may be a magnet or a magnet in combination with another device, such as a magnetizable rod or fastener magnetized by the magnet, and each magnetic field detector 1020 may be a Hall effect sensor. As noted above and described in more detail below, when the combination of a magnet and a magnetizable fastener is used to implement a magnetic field source 1022, the fastener may serve its classic function of securing one object to another while simultaneously participating in the setting of the output intensity of the light source 1001 by producing a magnetic field detectable by a magnetic field detector 1020 positioned in close proximity to the fastener (e.g., on a printed circuit board through which the fastener passes or located proximate the fastener). Alternatively, each magnetic field source 1022 may be an electrically activated coil that produces a resulting magnetic field and each magnetic field detector 1020 may be another coil or antenna capable of detecting the magnetic field produced by one of the magnetic field sources 1022. Of course, those of ordinary skill in the art will readily recognize and appreciate that the magnetic field source(s) 1022 and the magnetic field detector(s) 1020 may be implemented using a variety of other, conventional techniques.

A quantity of magnetic field sources 1022 and magnetic field detectors 1020 may be used to establish a quantity of possible output intensity levels for the lighting unit 10. Thus, in one embodiment, the memory 1005 may further store an intensity setting table 1016 or an equivalent database indicating an output intensity setting to be established by the controller 1003 based on the combination of possible outcomes produced by the magnetic field source(s) 1022 and detector(s) 1020. For example, when two magnetic field sources 1022 (e.g., magnets) and two magnetic field detectors 1020 are used to implement the output intensity adjustment mechanism 1007, there may be four possible intensity levels stored in the intensity setting table 1016 as follows: (1) a first (e.g., default) output intensity setting (e.g., 10 Watts or 500 lumens) when no magnetic fields are detected by the detectors 1020; (2) a second output intensity setting (e.g., 12 Watts or 630 lumens) when a magnetic field supplied by either one of the magnetic field sources 1022 is detected by a first one of the detectors 1020; (3) a third output intensity setting (e.g., 16 Watts or 750 lumens) when a magnetic field supplied by either one of the magnetic field sources 1022 is detected by a second one of the detectors 1020; and (4) a fourth output intensity setting (e.g., 20 Watts or 820 lumens) when magnetic fields supplied by the magnetic field sources 1022 are detected by both of the detectors 1020.

In an alternative embodiment, other combinations of sources and detectors may be used to implement the output intensity adjustment mechanism 1007. For example, one or more light sources (e.g., LEDs) and light detectors (e.g., photodiodes) may be used instead of or in combination with the magnetic field source(s) 1022 and the magnetic field detector(s) 1020. Alternatively or additionally, one or more electromagnetic or acoustic sources (e.g., antennas or transducers) and detectors (e.g., antennas or transducers) may be used. Still further, the output intensity adjustment mechanism 1007 may be implemented using only a detector, such as a photodiode detector. When only a photodiode is used to implement the output intensity adjustment mechanism 1007, the detection of ambient light by the photodiode, after the lighting unit 10 receives alternating current (AC) source power from the fixture in which the lighting unit 10 is installed, causes the controller 1003 to set the output intensity of the light source 1001 to a first level; whereas, failure of the photodiode to detect such ambient light causes the controller 1003 to set the output intensity of the light source 1001 to a second level.

The power supply 1009 may be any conventional supply that preferably receives AC power from supply wires of a light fixture into which the lighting unit 10 has been installed and either supplies AC power to the electrical components of the lighting unit 10 or converts the AC power to direct current (DC) power and supplies the DC power to the lighting unit electrical components. In a preferred embodiment, the power supply 1009 performs an AC-to-DC conversion to supply DC power to the controller 1003, the memory 1005, the output intensity adjustment mechanism 1007 (if necessary, depending upon implementation), and the light source 1001 (as controlled by the controller 1003 as detailed herein).

In one embodiment, the lighting unit 10 includes a first printed circuit board (PCB) 14 that supports the LEDs 801 or other light-generating devices. As shown in FIG. 9, the PCB 14 defines a wire pass-through aperture 803 and includes solder pads 66, 67 to which a set of wires 60, 61 originating from the PCB 47 supporting the controller 1003 are soldered. Additional details with respect to the construction of the PCB 14 are provided below with respect to FIG. 9.

Figure 2:
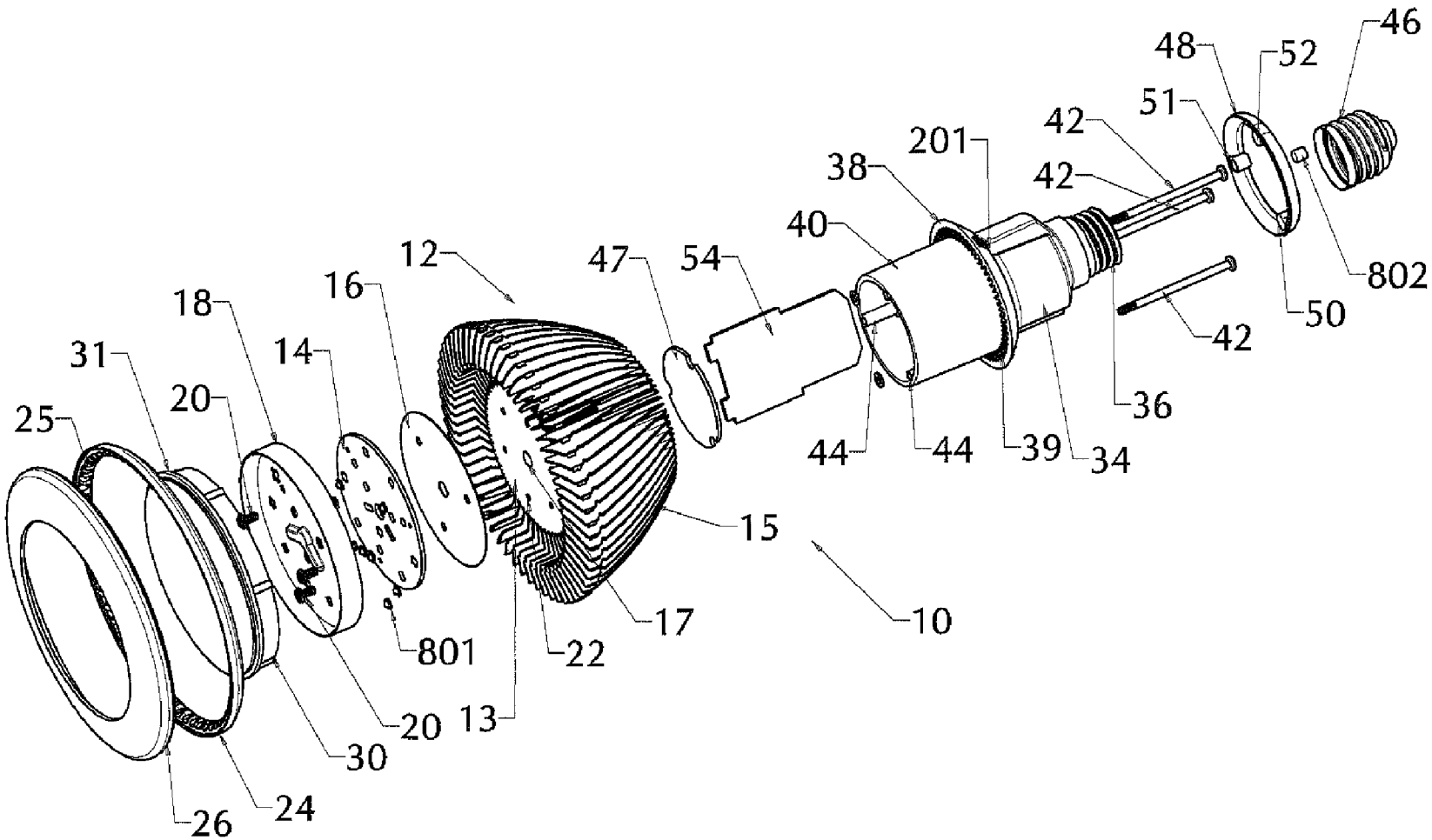
FIG. 2 is a perspective, right, front, exploded view of the lighting unit of FIG. 1.

The PCB 14 is connected to one side of a support plate, such as a hub 13 of a heat sink 12. A heat sink 12 may be employed when heat generated by the light source 1001 must be conducted away from the light source 1001 in order to prevent the light-generating elements of the light source 1001 (e.g., LEDs 801) from failing prematurely. If the thermal conductivity between the PCB 14 and the hub 13 is inadequate, the lighting unit 10 may further include a highly thermally conductive layer, such as a thermally conductive film or pad 16 cut into a shape similar to the shape of the PCB 14 or a thermally conductive paste, disposed between the PWB 14 and the hub 13 to improve the conduction of heat away from the PCB 14 and into the heat sink 12. Depending upon the heat dissipation requirements of the light source 1001, the heat sink 12 may employ a heat transfer structure, such as a set of cooling fins 15 as illustrated in FIGS. 1 and 2. In one embodiment, the heat sink 12 is designed to provide an external shape comparable to that of existing incandescent and/or halogen floodlights or track lights, such that the lighting unit 10 can be employed in conventional floodlight and track light fixture housings. For example, the lighting unit 10 may have the same general dimensions as a PAR 38 bulb or any other conventionally-sized bulb or lamp.

In a further embodiment in which the lighting unit 10 is optionally designed to meet UL approval for fire safety, the lighting unit 10 may further include a shield member 18 that functions to isolate and contain the current-carrying components of the PCB 14 from the lighting unit's lens and light source retention assembly (described in more detail below). Where fire safety is of concern, the shield member 18 may be fabricated from POLYLAC PA-765 ABS or any other electrically non-conductive (e.g., non-metallic), fire retardant material that preferably meets or exceeds the UL 94-V5 fire rating standard. In one embodiment as illustrated in FIG. 9, the shield member 18 is generally in the shape of a hollowed disc and includes a side wall section and a flat, base panel section 70. The base section 70 of the shield member 18 includes one or more LED lens apertures 74 and optionally one or more through holes 72 to permit the shield member 18, as well as the PCB 14 and the thermally conductive film 16 (when used), to be secured to the hub 13 of the heat sink 12. The lens apertures 74 are sized and shaped to receive the lenses of the LEDs 801, which are typically made from an epoxy resin. The shield member 18 is positioned between the PCB 14 and the lens 30 of the lighting unit 10 as illustrated in FIG. 2. The shield member 18 is described in more detail below with respect to FIG. 9. When the shield member 18 is employed and the shield member 18, the heat sink 12, and the lighting unit's base member 34 are all fabricated from materials that meet or exceed the UL 94-V5 fire rating standard and such lighting unit elements are joined together and secured such that the entire lighting unit 10 meets or exceeds the UL 94-V5 fire rating standard, the lighting unit 10 may be rated with a UL 94-V5 fire rating. The PCB 14, the thermally conductive film 16 (when included), and the shield member 18 (when included) are all secured to the hub 13 of the heat sink 12, such as by mounting screws 20 which can be screwed into threaded apertures or recesses 22 defined by the hub 13.

Figure 3:
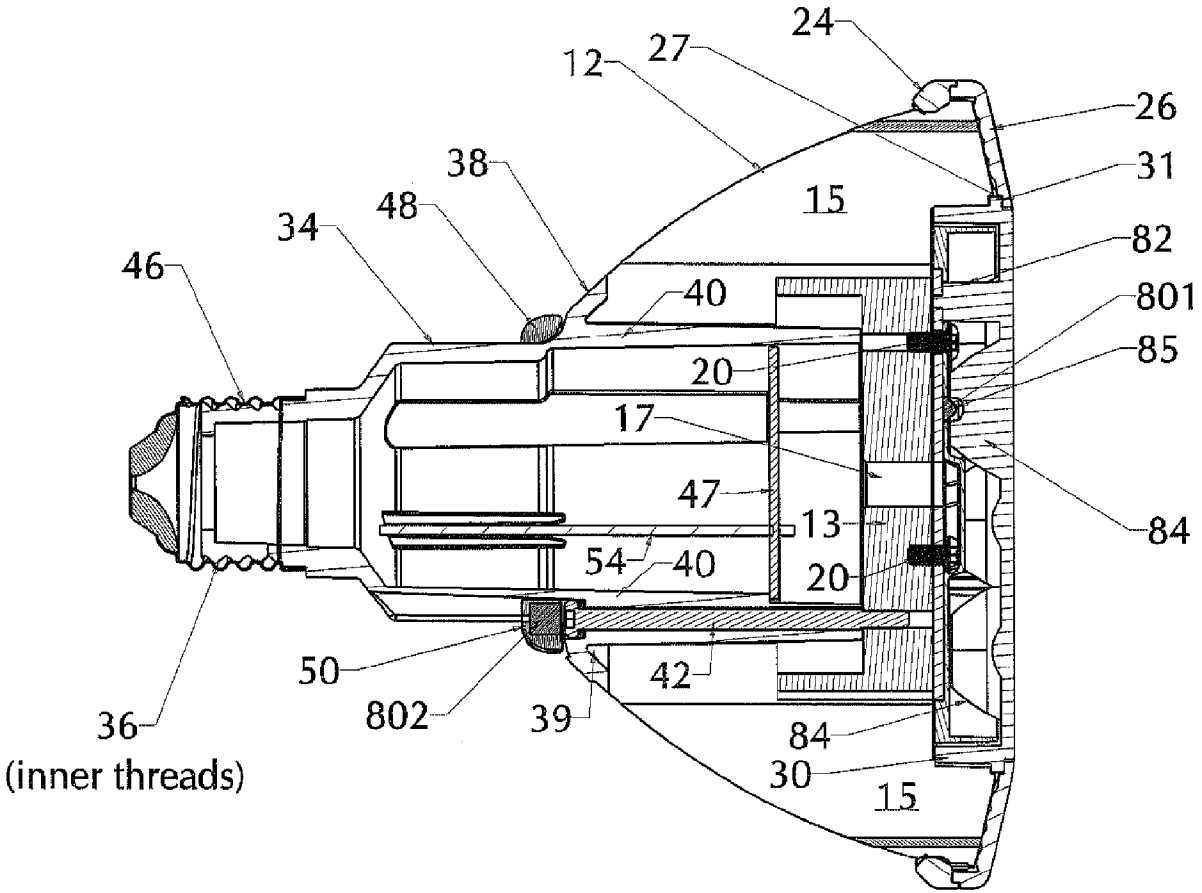
FIG. 3 is a right side, cross-sectional view of the lighting unit of FIG. 1.
Figure 4:
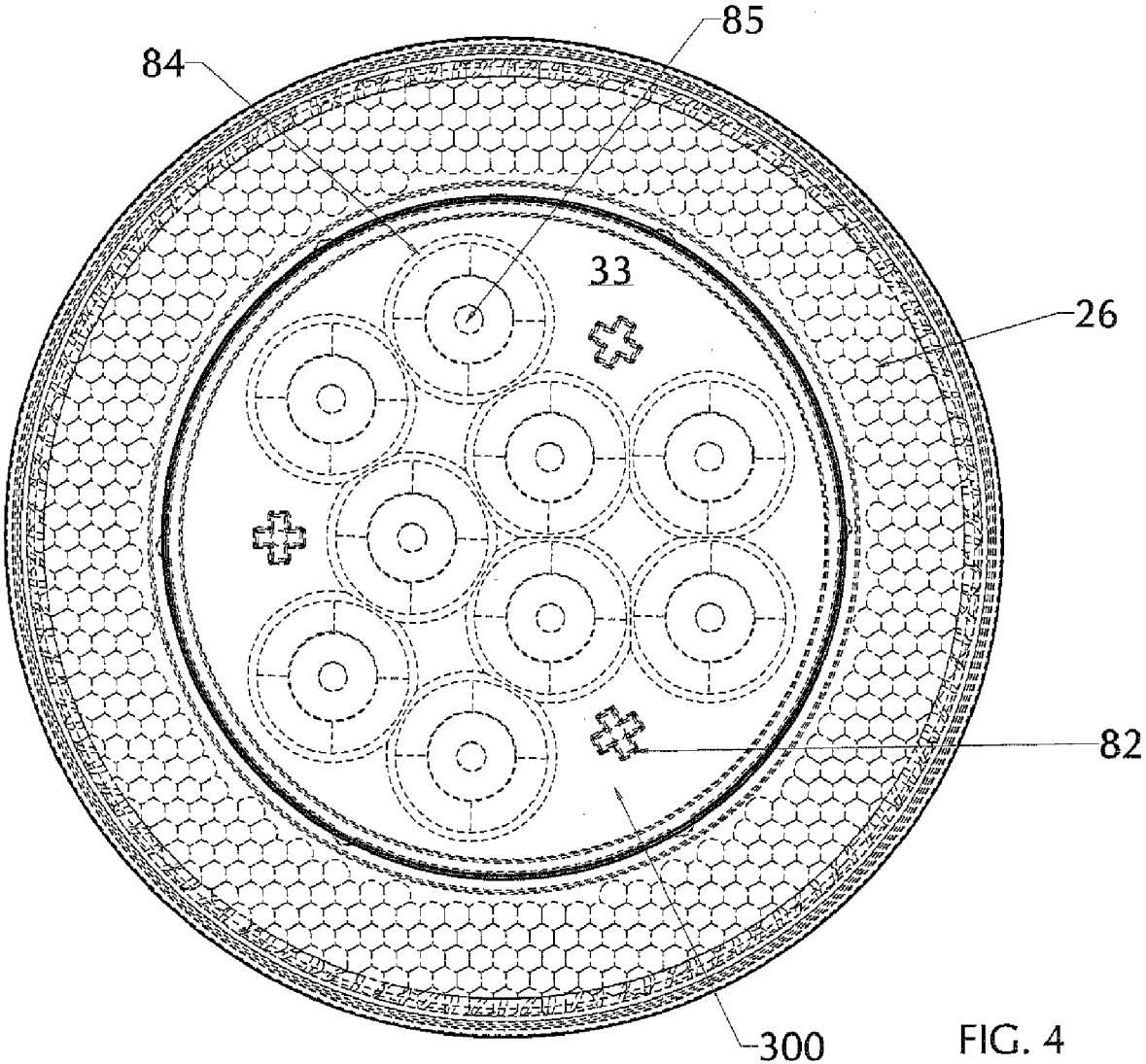
FIG. 4 is a front elevational view of the lighting unit of FIG. 1 illustrating one exemplary embodiment of a lens for the lighting unit and an associated configuration of LEDs.
Figure 5:
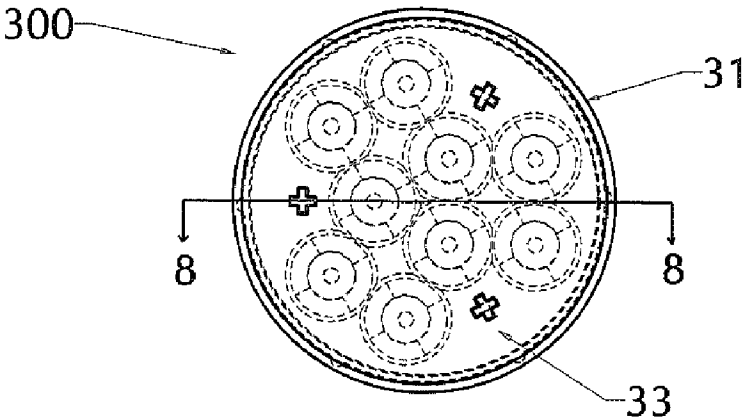
FIG. 5 is a front elevational view of a light concentrating lens element suitable for use with the lighting unit of FIG. 1.
Figure 6:
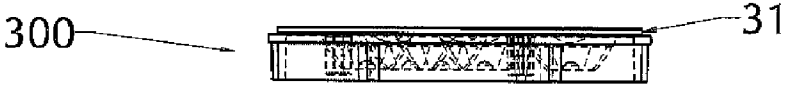
FIG. 6 is a side elevational view of the lens element of FIG. 5.
Figure 7:
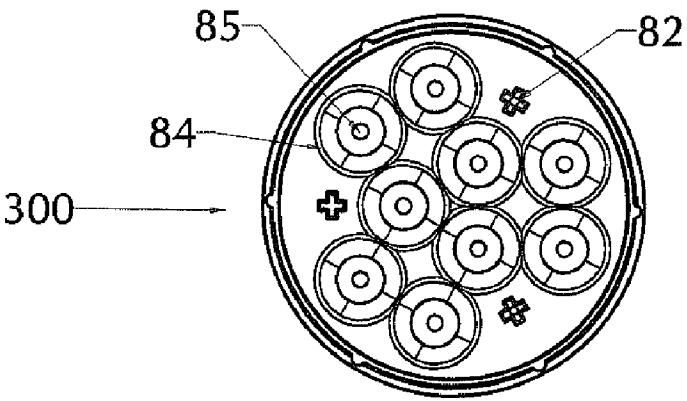
FIG. 7 is a rear elevational view of the lens element of FIG. 5.
Figure 8:
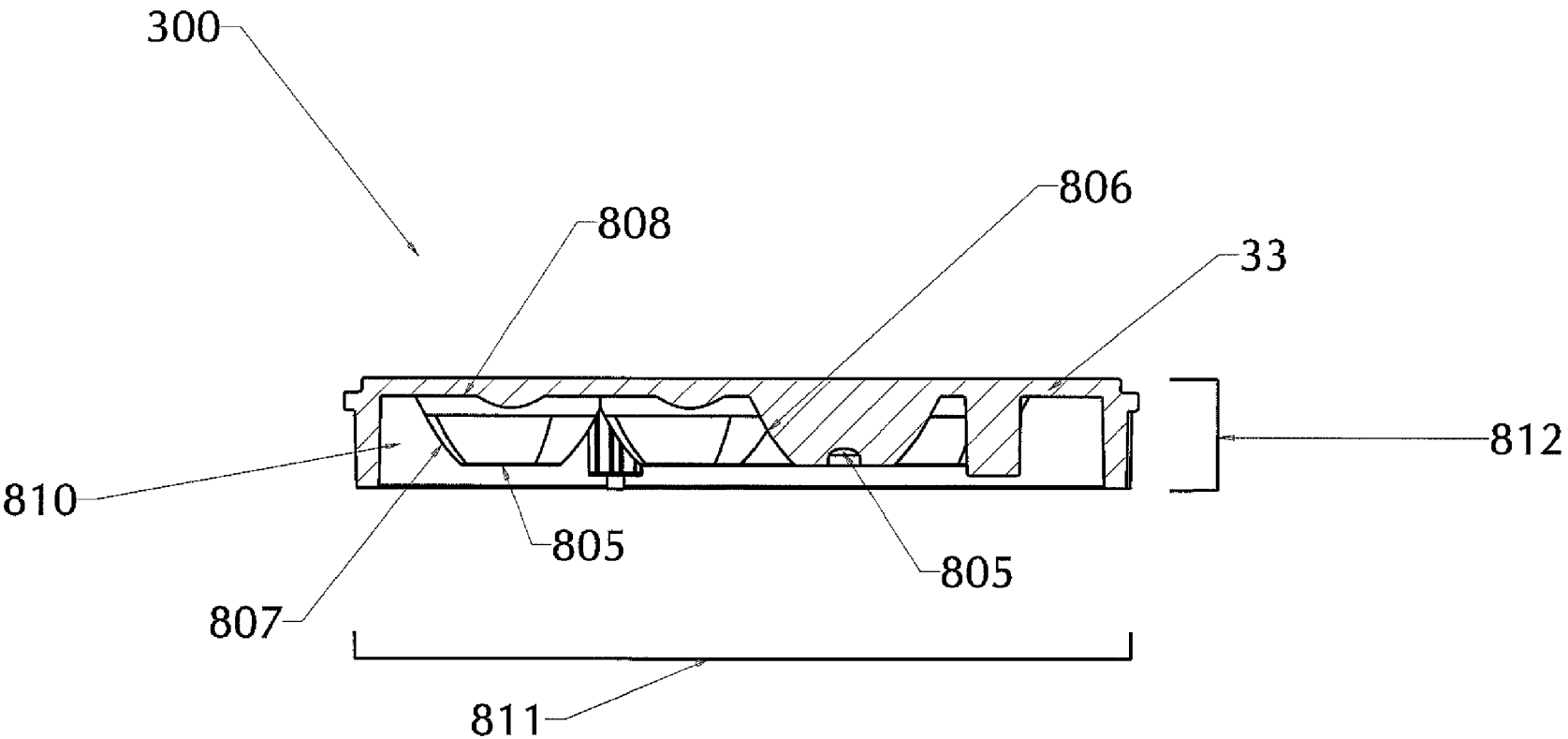
FIG. 8 is a cross-sectional view of the lens element of FIG. 5.

The embodiment of the lighting unit 10 shown in FIGS. 1-3 also includes a light source retention assembly. The assembly includes a lens 30, a bezel 26, and an optional upper fin retention ring 24 (which may be used when the heat sink 12 employs a set of cooling fins 15). When the fin retention ring 24 is included, the ring 24 defines on its interior surface a plurality of fin receiving sockets 25. A shoulder 27 defined by an inner wall of the bezel 26 cooperates with an annular shoulder 31 of the lens element 30 to sandwich the lens 30 between the shield member 18 (when included) or the PCB 14 (when the shield member 18 is not included) and the bezel 26 when the fin retention ring 24 and the bezel 26 are connected together, such as by ultrasonic welding.

FIGS. 4-8 illustrate one embodiment for a light concentrating lens element 300 suitable for use as the lens 30 of a lighting unit in accordance with the present invention (e.g., the lighting unit 10 of FIG. 1). The lens element 300 includes the annular shoulder 31 (which cooperates with an inner wall 27 of bezel 26 as discussed previously), a lens panel 33, and one or more light-concentrating members or collimators 84 constructed to reflect light energy emitted by the light-generating elements of the light source 1001 (e.g., the LEDs 801). The quantity of light-concentrating members 84 preferably equals the quantity of light-generating elements (e.g., LEDs 801) of the light source 1001.

The lens element 300 is preferably constructed of poly (methyl methacrylate) (PMMA), although various other materials may be used. For example, the lens element 300 may be alternatively constructed of acrylic, polycarbonate (PC), or glass. Each light-concentrating member 84 defines a receiving recess 85 for receiving a lens of a respective LED 801. The light-concentrating members 84 may be configured in any manner to obtain a desired optical effect therefrom. In one embodiment, each light-concentrating member 84 is generally conical in shape and includes the receiving recess 85 generally in the vertex end 805 of the light-concentrating member's cone. Additionally, in such embodiment, each light-concentrating member 84 is designed to provide total internal reflection (TIR). With such a configuration, light emitted from an LED 801 enters the vertex end 805 of the cone-shaped member 84, is reflected by the cone or collimating shape of the light-concentrating member 84 due to total internal reflection such that the light propagates through the body 807 of the light-concentrating member 84, and exits the base end 808 of the light-concentrating member 84. Total internal reflection is defined by Snell's law, which provides that for all angles between a critical angle ($\theta_{critical}$) and 90° (or −90° as applicable) relative to normal, light originating from a first material having a first refractive index ($n_1$) will be completely reflected at a boundary between the first material and a second material having a lower refractive index ($n_2$). According to Snell's law, $\theta_{critical}$ is given by the equation (Equation 1):

$$\theta_{critical}=\arcsin(n_2/n_1).$$

To achieve total internal reflection in one embodiment of the present invention, the material used to form the light-concentrating members 84 has a refractive index that is higher than a refractive index of the material surrounding the bodies 807 of the light-concentrating members 84 so that the light emanating from the LEDs 801 travels within the light-concentrating members 84 until the light exits such members 84 at their base ends 808 (i.e., at the lens panel 33). For example, in one embodiment, air is used to fill the space 810 surrounding the bodies 807 of the light-concentrating members 84 and the light-concentrating members 84 are formed from PMMA. In such an embodiment, the refractive index of air is less than the refractive index of PMMA. As a result, for angles greater than the critical angle as determined from Equation 1, light emanating form the LEDs 801 remains in the light-concentrating-members 84 by virtue of total internal reflection.

In one embodiment, the quantity of LEDs 801 is selected and arranged to produce a main, high intensity illumination over a narrow beam angle (i.e., horizontal and vertical angular ranges relative to a normal of the lens element 300) and a secondary, lower intensity illumination over broad beam angle. Such a configuration may be beneficial for use of the lighting unit 10 in a retail store to enable products placed in the high intensity portion of the beam to be emphasized, while providing sufficient light for general visibility of customers using the lower intensity portion of the beam. For example, the high intensity illumination may be in a beam angle of about 8 degrees (e.g., + or − about 4 degrees relative to normal in horizontal and vertical angular directions) and the secondary intensity illumination may be in a beam angle between about 8 degrees and about 100 degrees (e.g., from + or − about 4 degrees to + or − about 50 degrees relative to normal in horizontal and vertical angular directions). The high intensity illumination may be greater than or equal to about 150 candela and the secondary intensity illumination may be between about 100 candela and about 150 candela.

In one exemplary embodiment in which the lighting unit 10 is in the general mechanical form factor of a PAR 38 bulb, a diameter 811 of the lens element 300 is in the range of about 70 millimeters to about 80 millimeters and the height 812 of the lens element 300 is less than or equal to about 15 millimeters for a diameter to height ratio of at least about 5.33:1. In another exemplary embodiment, the quantity of LEDs 801 used is nine, although one skilled in the art will readily recognize and appreciate that other quantities of LEDs 801 may be used depending upon the size and desired output intensity of the lighting unit 10.

Figure 14:
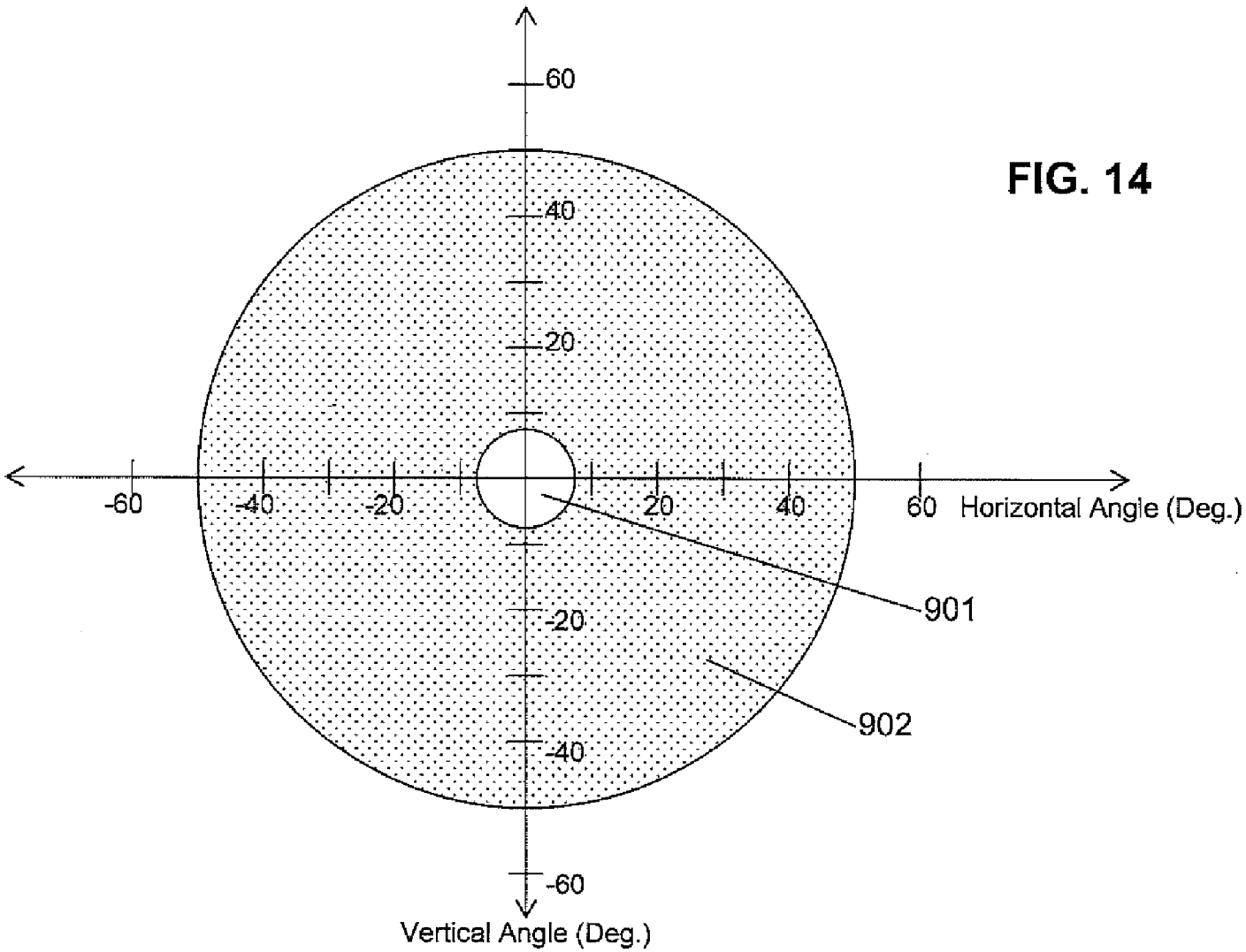
FIG. 14 is a two-dimensional graph illustrating output intensity versus horizontal and vertical angles relative to normal for an exemplary lighting unit in accordance with one embodiment of the present invention.
Figure 15:
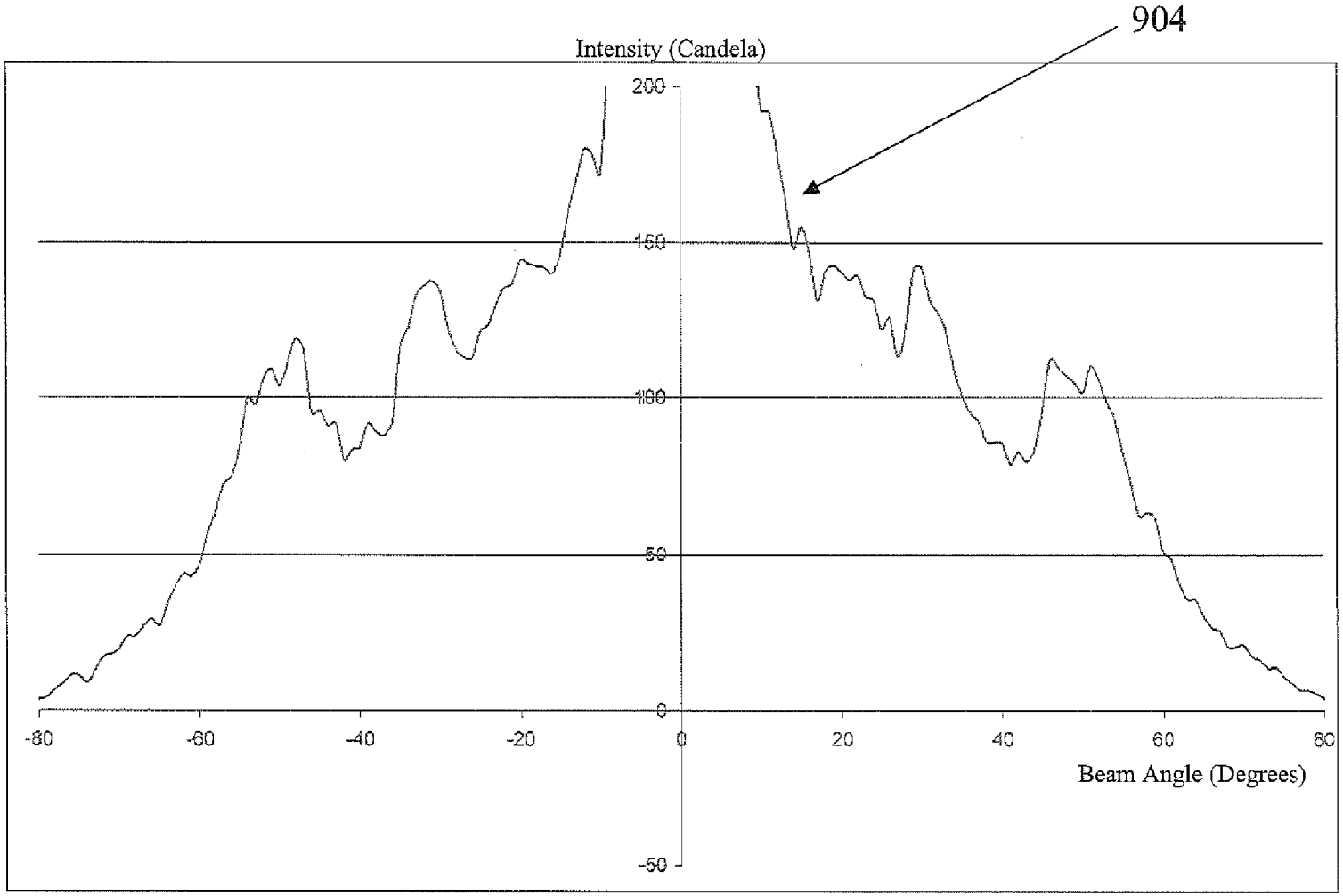
FIG. 15 is a graph illustrating output intensity versus beam angle relative to normal for an exemplary lighting unit in accordance with the embodiment illustrated in FIG. 14.

A two-dimensional graph illustrating exemplary output intensity versus horizontal and vertical angles relative to normal for an embodiment of the lighting unit 10 using nine LEDs 801 is shown in FIG. 14. An alternative graph illustrating exemplary output intensity 904 versus beam angle is shown in FIG. 15 for a similar embodiment. As illustrated in FIG. 14, the high intensity portion 901 of the light output is within horizontal and vertical angular ranges of about 8 degrees, from about −4 degrees to about +4 degrees, relative to normal and the lower intensity portion 902 of the light output is within horizontal and vertical angular ranges of about 92 degrees, from about −4 degrees to about −50 degrees and from about +4 degrees to about +50 degrees, relative to normal. In the illustrated embodiment, the higher intensity portion 901 does not overlap the lower intensity portion 902 of the light output. In an alternative embodiment, the light output may not be perfectly symmetrical and circular in nature, but may instead resemble a rounded-off rectangle or rounded-off square pattern as opposed to the exemplary circular light pattern illustrated in FIG. 14.

As illustrated in FIG. 15, the high intensity portion 901 of the output beam may provide an output intensity 904 of at least 150 candela over a beam angle of about 8 degrees or more (e.g., about 36 degrees as illustrated in FIG. 15). The lower intensity portion 902 of the output beam may provide an output intensity 904 of between about 100 candela and about 150 candela over a much broader beam angle of about 80 degrees or more (e.g., from about −18 degrees to about −58 degrees relative to normal as illustrated in FIG. 15). In alternative embodiments, the quantity of LEDs 801 and the configuration of the light-concentrating members 84 may be selected to produce varying intensity light over other beam angle ranges.

In addition to being generally conically-shaped, the inner surface 806 of each light-concentrating member 84 may include ridges or facets (not shown) to further aid in efficiently directing or reflecting light emanating from the LED 801. As noted above and illustrated in FIG. 8, each light-concentrating member 84 is attached at one end (e.g., at the base end 808 of the cone) to a preferably transparent lens panel 33 that covers and protects the lens-concentrating members 84. The lens panel 33 is preferably fabricated from the same type of material as is used to fabricate the lens element 300 (e.g., PMMA, acrylic, polycarbonate, or glass). One or more alignment lugs 82 may be optionally employed to assist in locating the lens element 300 in a proper orientation relative to the PCB 14 and/or the shield member 18 (when included), such that the LEDs 801 mounted on the PCB 14 are in substantial registry with the lens apertures 74 of the shield member 18 and the receiving recesses 85 of the lens element 300. The lugs 82, when included, cooperate with corresponding lug receiving apertures 73 defined by the shield member 18 (when included), as shown in FIGS. 3 and 9.

Referring now to FIG. 9, PCB 14 has mounted thereto a plurality of LEDs 801 (nine shown). The quantity of LEDs 801 or other light-generating elements mounted on the PCB 14 may be selected based on a variety of factors, including the type of light-generating element, the desired maximum output intensity, the lens configuration, and other factors. In one embodiment, the PCB 14 also defines a wire pass-through aperture 803 and includes solder pads 66, 67 and conductive traces (not shown) connecting the solder pads to the LEDs 801. The wires 60, 61 providing electrical power to drive the LEDs 801 pass through the wire pass-through aperture 803 and are soldered to the solder pads 66, 67. The PCB 14 also optionally defines mounting screw through-holes 62 adapted to permit mounting screws 20 to be used to secure the PCB 14 to the hub 13 of the heat sink 12.

As also illustrated in FIG. 9, the shield member 18, which is preferably fabricated from a material that is fire retardant and non-electrically conductive, includes a substantially flat panel section 70 adapted to be placed in registry with the PCB 14 supporting the LEDs 801. The panel 70 defines the lug receiving apertures 73, mounting screw holes 72, and LED lens apertures 74. When the shield member 18 is positioned upon and in registry with the PCB 14, the lenses of the LEDs 801 protrude through the receiving apertures 74. In one embodiment, the shield member 10 further defines a raised, solder and wire guard cavity 78, which resides in substantial registry with the wires 60, 61 originating from the controller PCB 47 and their respective solder pads 66, 67. When the shield member 18 is positioned upon the LED PCB 14, the solder and wire guard cavity 78 encloses the portions of the wires 60, 61 passing through the wire pass-through aperture 803 of the LED PCB 14, as well as the solder joints formed by the solder connection of the wires 60, 61 to their associated solder pads 66, 67. The solder and wire guard cavity 78 creates a mechanical, preferably fire-proof barrier between the wires 60, 61 and solder joint(s) residing within the cavity 78 and the lens assembly or anything else coming into contact with the shield member 18.

Lighting unit 10 also includes, in one embodiment, a generally cylindrical base member 34 having a threaded terminal end 36, a retention collar 38, a central section connecting the threaded end 36 to the retention collar 38, and a base hub 40 defining an interior cavity which is at least partially hollow. The threaded terminal end 36 of the base member 34 is adapted to receive a corresponding conductive, threaded cap 46. The threads of the cap 46 mate with threads in a lighting fixture into which the lighting unit 10 may be installed. In one embodiment in which the lighting unit's heat sink 12 includes a set of cooling fins 15, the retention collar 38 may define a plurality of fin receiving sockets 39 on its inner surface. When the base member's hub 40 is inserted into a mating cavity in the heat sink 12, the fin receiving sockets 39 of the retention collar 38 receive and engage the fins 15 of the heat sink 12 to provide support for the fins 15 and effectively lock the base member 34 in place.

In one exemplary embodiment, the base member 34 defines, in an outer surface of its central section, at least one elongated and recessed channel that lies in registry with one or more corresponding journals 44 connected to or defined by an inner surface of the base member's hub 40. In the embodiment illustrated in FIGS. 1-3 and 10A-10C, the base member 34 defines three equally spaced apart channels 50', 51', 52'. Each channel 50', 51', 52' terminates at one end in a wall 201 defining an aperture. The wall 201 may form part of the retention collar 38. One or more, preferably magnetizable fasteners, such as base mounting screws 42 that include ferromagnetic materials, pass through the wall apertures and the base screw journals 44 and engage threaded apertures 49 in a rear support plate defined by the heat sink hub 13.

Prior to securing the base member 34 to the heat sink hub 13, PCBs 47, 54 containing the power supply 1009, the controller 1003, the memory 1005, and at least part of the output intensity adjustment mechanism 1007 (e.g., the magnetic field detector(s) 1020) are arranged and connected to one another within the base member hub 40 and upon the rear support plate defined by the heat sink hub 13. Thus, as illustrated in FIG. 1, the PCBs 47, 54 supporting the power supply 1009, the controller 1003, the memory 1005, and the magnetic field detector(s) 1020 are spaced apart from the PCB 14 supporting the LEDs 801. As a result, the set of wires 60, 61 are used to supply power from the power supply and/or controller PCBs 47, 54 to the LED PCB 14.

When the output intensity adjustment mechanism 1007 includes magnetic field detectors 1020 (e.g., Hall effect sensors), the detectors 1020 are preferably arranged on the controller PCB 47 such that the detectors are proximate through holes or cutouts that accommodate the fasteners connecting the base member 34 to the heat sink hub 13. Upon completion of fastening the base member 34 to the heat sink hub 13 using the base screws 42, the heads of the base screws 42 engage the walls 201 of the channels 50', 51' and 52' to secure the retention collar 38 to the heat sink 12.

In one embodiment, the lighting unit 10 further includes a removable, generally circular ring member 48 adapted to be placed over the base member 34. When the base member 34 is configured to have recessed channels 50', 51', 52' as shown in FIGS. 1 and 10A-10C, the ring member 48 includes at least one socket 50, 51, 52 (three shown in FIGS. 1 and 10A-10C) projecting toward the center of a circle defined by the ring member 48. The sockets 50, 51, 52 are preferably configured to fit within the channels 50', 51', 52' of the base member 34. For example, where the channels 50', 51', 52' are generally semi-cylindrical in shape, the sockets 50, 51, 52 of the ring member 48 may also be generally semi-cylindrical in shape when taking into account a thickness of the ring member 48. One or more of the ring member sockets 50, 51, 52 may include a recess for receiving a magnetic field source 1022 or other source forming part of the output intensity adjustment mechanism 1007. For example, the socket recess may be large enough to receive and retain a small magnet 802.

After the base member 34 has been secured to the hear sink hub 13 using the magnetizable screws 42, the ring member 48 is positioned (e.g., rotated) about the base member 34 such that the sockets 50, 51, 52 reside within the channels 50', 51' and 52' and are in contact with the heads of the screws 42. In a preferred embodiment, at least one of the sockets 50, 51, 52 includes a magnet 802 (e.g., a disc-shaped magnet) and the magnet 802 attaches to the head of one of the screws 42, magnetizing the screw 42 and retaining the ring member 48 substantially adjacent the retention collar 38. Of course, more than one of the sockets may include a magnet 802. Magnetization of the screw 42 causes a magnetic field to be present proximate the screw 42. Thus, the magnetic field detector 1020 proximate the magnetized screw 42 detects the magnetic field and sends a signal to the controller 1003 indicating detection of the magnetic field. Based upon receipt of the signal and execution of a light intensity control algorithm 1011, the controller 1003 retrieves the output intensity to be set from the intensity setting table 1016 (e.g., when multiple intensity levels are possible) and controls the supply of electrical power from the power supply 1009 to the light source 1001 (e.g., LEDs 801) based on the retrieved intensity level. As noted above, the quantity of magnets 802 and magnetic field detectors 1020 determine the quantity of possible output intensities. For example, when only one magnet 802 and three magnetic field detectors 1020 are used, there are four possible output intensities: a first, default intensity when the ring member 48 is excluded, a second intensity when the magnet 802 is positioned upon a first screw head, a third intensity when the magnet 802 is positioned upon a second screw head, and a fourth intensity when the magnet 802 is positioned upon a third screw head. In such a case, the set of possible intensity levels and their associated triggers are stored in the intensity setting table 1016.

Figure 10A:
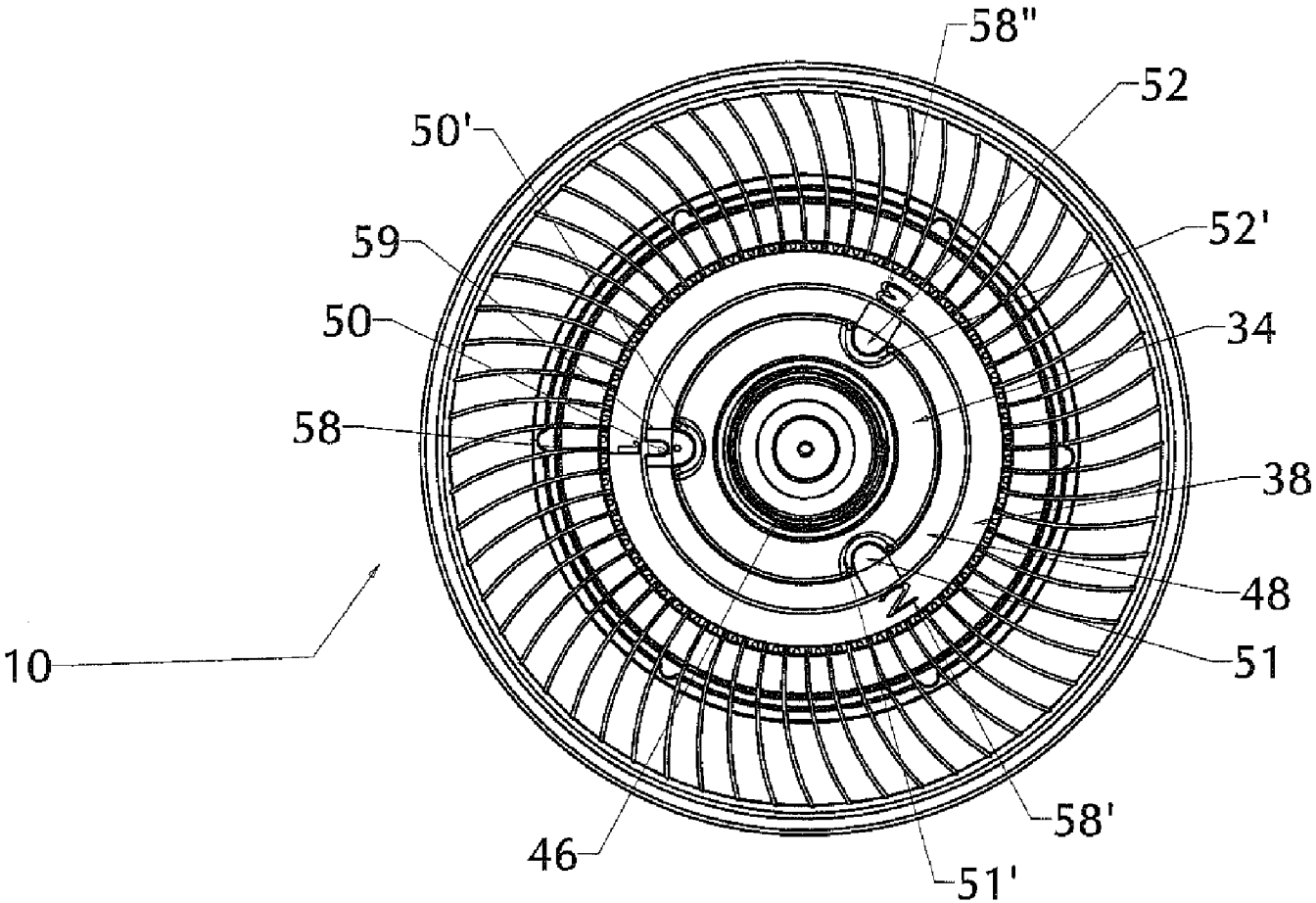
FIG. 10A is a rear view of the lighting unit of FIG. 1 showing a ring member thereof in a first position corresponding to a first output intensity of the lighting unit.
Figure 10B:
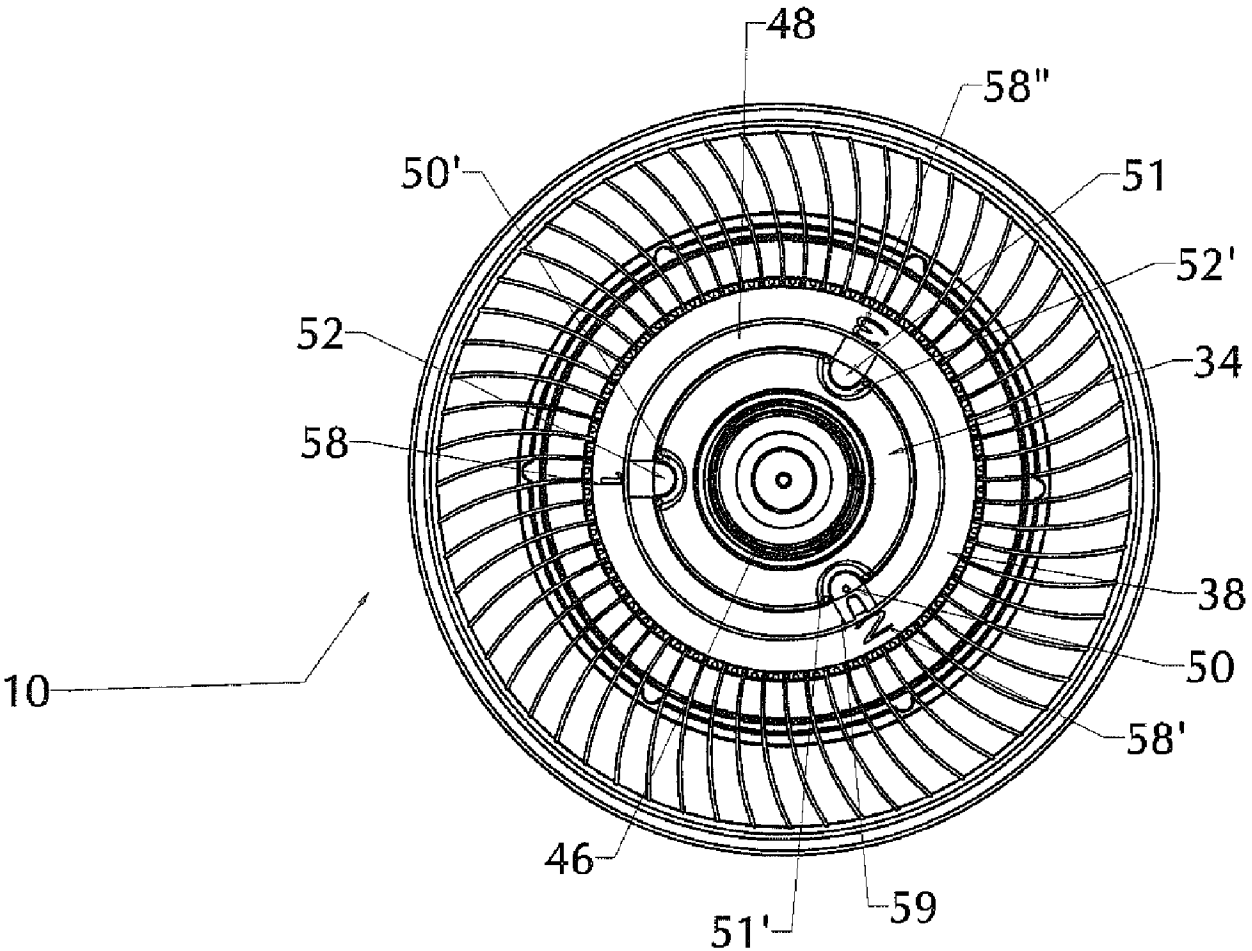
FIG. 10B is a rear view of the lighting unit of FIG. 1 showing a ring member thereof in a second position corresponding to a second output intensity of the lighting unit.
Figure 10C:
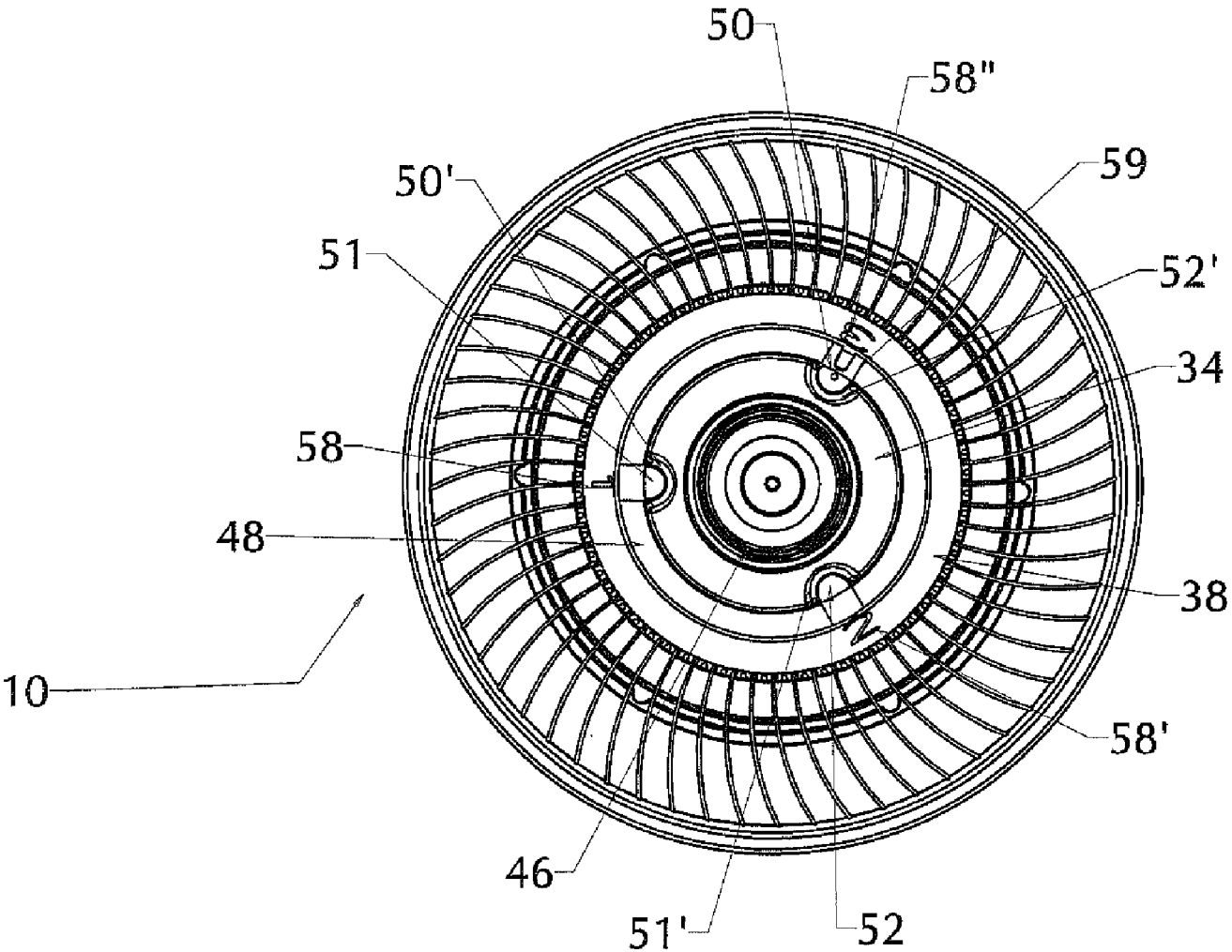
FIG. 10C is a rear view of the lighting unit of FIG. 1 showing a ring member thereof in a third position corresponding to a third output intensity of the lighting unit.

The retention collar 38 may also include indicia 58 as illustrated in FIGS. 1 and 10A-10C to inform a user as to which intensity setting is being set based on positioning of the ring member 48 about the base member 34 and onto the magnetizable fasteners (e.g., screws 42). For example, where only one of the ring member sockets 50 includes a magnet 802, positioning of the magnet 802 upon the screw head adjacent the indicia 58 marked "1" may inform the user that he/she is selecting the lowest possible output intensity level. On the other hand, positioning of the magnet 802 upon the screw head adjacent the indicia 58 marked "3" may inform the user that he/she is selecting the highest possible output intensity level (e.g., where three screws 42 and one magnet 802 are used as the selectable magnetic field source 1022). FIGS. 10A-10C show the ring member 48 positioned in the three possible configurations provided by the embodiment illustrated in FIGS. 1-3. To inform a user as to the current output intensity level setting, the ring member 48 may include a marker, notch, or other indicator 59 that can be aligned substantially with one of the indicia 58, 58', 58" on the retention collar 38. For example, the ring member indicator 59 may be arranged on the ring member 48 such that the indicator 59 is disposed on or formed into an outer surface of the ring member 48 adjacent the ring member socket 50 retaining the magnet 802. Those of ordinary skill in the art will readily recognize and appreciate that more or fewer ring member positions may be possible depending upon the quantity of base member channels and ring member sockets. Those of ordinary skill in the art will also recognize and appreciate that the geometric configurations of the base member 34 and the ring member 48 may vary depending upon the desired mechanical configuration of the lighting unit 10.

After the lighting unit 10 has been assembled and the output intensity selected, the lighting unit 10, via base cap 46, may be threaded into a lighting fixture (not shown) for which the lighting unit 10 was designed. Once the lighting unit 10 has been installed in its fixture, the ring member 48 cannot be moved so as to realign the ring member sockets 50, 51 and 52 in a different orientation relative to base member channels 50', 51', 52'. Thus, integration of the output intensity adjustment mechanism 1007 into the base portion of the lighting unit 10 acts as a safety feature, as well as prevents the unwanted readjustment of fewer than all of the lights in a lighting space. By requiring the physical unscrewing of the lighting unit 10 from the electrical socket of a lighting fixture into which the lighting unit 10 has been installed, the tendency and opportunity for tampering with the lighting unit 10 while installed in the fixture may be reduced or eliminated altogether.

FIG. 12 is a flow diagram 1100 of steps executed by a lighting unit 10 to report usage information optically via a primary light source 1001 of the lighting unit 10 in accordance with an alternative embodiment of the present invention. When the lighting unit 10 is turned on, the controller 1003 starts a timer 1013, which may be internal to the controller 1003 or external to the controller 1003 and coupled to it. The timer 1013 records (1101) the amount or duration of time that the light source 1001 was illuminated (on time). When the lighting unit 10 is turned off, the timer 1013 retains a value for the on time. When the lighting unit 10 is turned back on (or after power was previously shut off if the shut off circuitry for the lighting unit 10 includes circuits for turning the unit 10 off slowly upon removal of AC power), the controller 1003 retrieves the on time from the timer 1013 and determines whether the memory 1005 already includes time data 1015 for the lighting unit 10. When no time data 1015 exists, the controller 1003 stores the time retrieved from the timer 1013 as a value in the time data portion 1015 of the memory 1005. If time data 1015 already exists, then the controller 1003 retrieves the time data 1015 from the memory 1005, determines (1103) the cumulative amount of time the light source 1001 has been illuminated based on the time data 1015 and the timer value, and updates (1105) the time data value stored in the memory 1005 to reflect the cumulative on time for the light source 1001.

While monitoring the cumulative amount of time that the light source 1001 has been illuminated, the lighting unit controller 1003 determines (1107) whether a reporting time interval has arrived for reporting usage information for the lighting unit 10. The controller 1003 may determine that a reporting interval has arrived based on a variety of factors, including the cumulative amount of time that the light source 1001 has been illuminated, whether such amount of time corresponds to a point on a lumen depreciation curve 1017 (e.g., an L70 curve for a particular LED) stored in the memory 1005 indicating, based on the cumulative on time, that the light source 1001 has likely decreased in illumination, time of day, time since lighting unit installation, and so forth. For example, the controller 1003 may determine whether a reporting time interval has arrived based on whether the cumulative amount of time that the light source 1001 has been illuminated is greater than or equal to a threshold (e.g., 1000 hours or the point on the lumen depreciation curve 1017 at which the light source 1001 has likely decreased in illumination by 30%). Alternatively, the controller 1003 may determine reporting intervals periodically and, therefore, determine whether a predetermined amount of time (e.g., corresponding to the reporting interval period) has passed since a previous reporting time interval. Still further, the controller 1003 may determine a reporting interval in response to a request for usage information from a user (e.g., via a signal communicated to the controller 1003).

If the controller 1003 determines that a reporting interval has not arrived, the controller 1003 and/or the timer 1013 continues to monitor and record the light source's cumulative on time. On the other hand, if the controller 1003 determines that a reporting interval has arrived, the controller 1003 optically reports (1109) usage information for the lighting unit 10 via the lighting unit's primary light source 1001. In one embodiment, the controller 1003 modulates or pulses the supply of electrical power to the light source 1001 such that the light source 1001 optically communicates an information signal 1023 that is visually undetectable by the human eye. For example, the light may be pulsed at a frequency (e.g., 50 kHz or any other frequency greater than about 120 Hz) that is faster than the human eye can detect. In such a case, the user may use a pulsed light detector 1025 or other appropriate detector to detect and decode the signal. The information signal may include the cumulative amount of time that the light source 1001 has been illuminated, warranty data 1018 (which may have been stored in the memory 1005 at the time of manufacture or installation of the lighting unit 10), lighting unit temperature data, or other usage information. The user can then use the reported data to determine whether the light source 1001 needs to be changed or whether any other changes need to be made to a lighting system that includes the lighting unit 10.

FIG. 13 is a flow diagram 1200 of steps executed by a lighting unit controller 1003 to automatically adjust power supplied to a light source 1001 of the lighting unit 10 to maintain a predetermined output power in the presence of expected lumen depreciation in accordance with an alternative embodiment of the present invention. A lumen depreciation curve 1017 (e.g., a L70 curve for a particular type of LED 801) is stored (1201) in the memory 1005 of the lighting unit 10. Such storage may occur at the time of manufacture of the lighting unit 10. Some time after the lumen depreciation curve 1017 has been stored, the controller 1003 determines (1203) the cumulative on time for the light source 1001 (e.g., set of LEDs 801). The on time determination may be made using a timer 1013 and stored time data 1015 as described above with respect to FIG. 12. The controller 1003 then determines (1205) whether the intensity of the light source 1001 is likely decreasing based on the cumulative on time and the stored lumen depreciation curve 1017. For example, the controller 1003 may find the cumulative on time on the time axis of the lumen depreciation curve 1017 and then determine, from the curve data 1017, the output intensity expected for the light source 1001.

If the intensity of the light source 1001 is not yet likely decreasing based on the cumulative on time and the lumen depreciation curve 1017, then the controller 1003 continues monitoring the cumulative on time for the light source 1001. Alternatively, if the intensity of the light source 1001 is likely decreasing based on the cumulative on time and the lumen depreciation curve 1017, then the controller 1003 adjusts (1207) the supply of electrical power to the light source 1001 (e.g., LEDs 801) based on the cumulative amount of time that the light source 1001 has been illuminated and the lumen depreciation curve 1017. For example, the controller 1003 may increase the supply of electrical power to the light source 1001 in an attempt to increase the output intensity of the light source 1001 and thereby maintain the output intensity of the light source 1001 as originally or most recently set by the user. The controller 1003 may determine the amount of the increase in electrical power based on the lumen depreciation curve data 1017 or other light source (e.g., LED) characteristic data stored in the memory 1005. For instance, LED manufactures produce curves relating increases in supplied current to an LED to increases in output intensity from the LED. The controller 1003 may utilize such data to determine how much to increase the current supplied to the light source 1001 (when implemented with LEDs 801).

The present invention encompasses a self-contained, replaceable lighting unit with user-settable output intensity designed for use in a light fixture, and associated methods of operation to optically report usage information and maintain output intensity notwithstanding lumen depreciation over time. With this invention, a user may manually set or adjust the output intensity of the lighting unit without requiring access to any of the internal electrical components of the lighting unit. Additionally, when the optional shield member is used to isolate the current carrying portions of the light source from the non-current carrying portions and, thereby effectively enclose the current carrying portions of the lighting unit within a multi-piece housing, the lighting unit of the present invention may meet the fire rating requirements of the UL 94-V5 standard when the shield member and the other portions of the multi-piece housing are manufactured from materials that are also UL 94-V5 compliant. Further, by monitoring the cumulative amount of time the lighting unit is illuminated and determining the expected output intensity of the light source based on a lumen depreciation curve for the light source, the present invention allows the electrical power supplied to the light source to be adjusted to maintain the original or most recently set output intensity for most, if not all, of the remaining operating life of the light source. Still further, by appropriately modulating or pulsing the electrical power supplied to the light source such that the light source turns on and off at a frequency undetectable by the human eye, the present invention permits a visually undetectable information signal to be communicated from the primary light source of the lighting unit so as to permit usage information for the lighting unit to be reported at desired reporting intervals.

As detailed above, embodiments of the present invention reside primarily in combinations of method steps and apparatus components related to operating a replaceable lighting unit with adjustable output intensity and optional usage information reporting capability. Accordingly, the apparatus components and method steps have been represented, where appropriate, by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as "first" and "second," "top" and "bottom," and the like may be used solely to distinguish one object or action from another object or action without necessarily requiring or implying any actual relationship or order between such objects or actions. The terms "includes," "comprises," "including," "comprising," and any other variations thereof are intended to cover a non-exclusive inclusion, such that a process, method, article, or apparatus that comprises or includes a list of elements does not include only those elements but may include other elements not expressly listed or inherent to such process, method, article, or apparatus. The term "plurality of" as used in connection with any object or action means two or more of such object or action. A claim element proceeded by the article "a" or "an" does not, without more constraints, preclude the existence of additional identical elements in the process, method, article, or apparatus that includes the element.

It will be appreciated that embodiments of the lighting unit described herein may be comprised of one or more conventional processors (e.g., implementing the controller 1003) and unique stored program instructions that control the processor(s) to implement, in conjunction with certain non-processor circuits, some, most, or all of the functions of the lighting unit and its operational methods as described herein. The non-processor circuits may include, but are not limited to, the power supply 1009, the memory 1005, the power set detection mechanism 1007, and the primary light source 1001 described above, as well as filters, LED drivers, clock circuits, over-current protection circuits, and various other non-processor circuits. As such, the functions of these non-processor circuits may be interpreted as steps of a method to operate a lighting unit to provide adjustable output intensity (lumens) and optionally report usage information optically. Alternatively, some or all functions of the controller 1003 could be implemented by a state machine that has no stored program instructions, or in one or more application specific integrated circuits (ASICs), in which each function or some combinations of certain of the functions are implemented as custom logic. Of course, a combination of the above approaches could be used. Thus, methods and means for these functions have been generally described herein. Further, it is expected that one of ordinary skill in the art, notwithstanding possibly significant effort and many design choices motivated by, for example, available time, current technology, and economic considerations, when guided by the concepts and principles disclosed herein, will be readily capable of generating such software instructions or programs and integrated circuits without undue experimentation.

In the foregoing specification, specific embodiments of the present invention have been described. However, one of ordinary skill in the art will appreciate that various modifications and changes can be made without departing from the scope of the present invention as set forth in the claims below. For example, while the foregoing description has focused on use of a finned heat sink structure to assist in cooling LEDs when such devices are used as the light source for the lighting unit, the finned heat sink may be replaced by a generally conical structure (which may be metallic and serve as a heat sink) to enable the lighting unit to resemble the more conventional shape of a halogen light bulb. Additionally, while the foregoing description has focused on the use of multiple LEDs to implement the light source, such LEDs may be replaced with a single LED or other electronically-controllable, light generating devices. Accordingly, the specification and figures are to be regarded in an illustrative rather than a restrictive sense, and all such modifications are intended to be included within the scope of present invention. The benefits, advantages, solutions to problems, and any elements) that may cause any benefit, advantage, or solution to occur or become more pronounced are not to be construed as critical, required, or essential features or elements of any or all the claims.

What is claimed is:

1. A self-contained, replaceable lighting unit with user-settable output intensity designed for use in a light fixture, the lighting unit comprising:

a power supply;

at least one light emitting diode (LED);

an output intensity adjustment mechanism configured to allow a user to set an output intensity of a plurality of non-zero output intensities generatable by the at least one LED;

a controller operably coupled to the power supply, the at least one LED and the output intensity adjustment mechanism, the controller operable to control a supply of electrical power from the power supply to the at least one LED such that the at least one LED illuminates in accordance with the output intensity set by the user;

at least one light-concentrating member positioned in substantial registry with the at least one LED and defining at least one receiving recess, the at least one receiving recess receiving the at least one lens of the at least one LED;

at least a first printed circuit board supporting at least the controller;

a second printed circuit board supporting the at least one LED and being separated from the at least a first printed circuit board, the second printed circuit board defining a wire pass-through aperture and including a set of solder pads;

a set of wires electrically connecting the at least a first printed circuit board and the set of solder pads, the set of wires passing through the wire pass-through aperture and being soldered to the solder pads, the solder pads being electrically coupled to the at least one LED; and a non-metallic shield member secured to the second printed circuit board and positioned between the second printed circuit board and the at least one light-concentrating member, the shield member defining a cavity that encloses the set of wires and the set of solder pads.

2. The lighting unit of claim 1, wherein the shield member has a UL 94-V5 fire rating.

3. The lighting unit of claim 2, wherein the lighting unit has a UL 94-V5 fire rating.

4. The lighting unit of claim 1, wherein the shield member further defines at least one LED lens aperture and wherein the at least one LED lens aperture is substantially in registry with the at least one receiving recess of the at least one light-concentrating member such that the at least one lens of the at least one LED passes through the at least one lens aperture of the shield member and into the at least one receiving recess of the at least one light-concentrating member.

5. A self-contained, replaceable lighting unit with user-settable output intensity designed for use in a light fixture, the lighting unit comprising:

a power supply;

at least one light emitting diode (LED);

an output intensity adjustment mechanism configured to allow a user to set an output intensity of a plurality of non-zero output intensities generatable by the at least one LED;

a controller operably coupled to the power supply, the at least one LED and the output intensity adjustment mechanism, the controller operable to control a supply of electrical power from the power supply to the at least one LED such that the at least one LED illuminates in accordance with the output intensity set by the user;

a timer coupled to the controller and operable to determine an amount of time that the at least one LED has been illuminated; and a memory coupled to the controller and operable to store a value representing a cumulative amount of time that the at least one LED has been illuminated and at least one lumen depreciation curve indicating an estimated variation in output intensity of the at least one LED over time;

wherein the controller is further operable to:

adjust the supply of electrical power from the power supply to the at least one LED based on the stored value representing the cumulative amount of time that the at least one LED has been illuminated and the at least one lumen depreciation curve.

6. The lighting unit of claim 5, wherein the controller is operable to adjust the supply of electrical power to the at least one LED by increasing the supply of electrical power when the stored value representing the cumulative amount of time that the at least one LED has been illuminated corresponds to a point on the at least one lumen depreciation curve indicating that an output intensity of the at least one LED has decreased.

7. A self-contained, replaceable lighting unit with user-settable output intensity designed for use in a light fixture, the lighting unit comprising:

a power supply;

a light source;

an output intensity adjustment mechanism configured to allow a user to set an output intensity of a plurality of non-zero output intensities generatable by the light source;

a controller operably coupled to the power supply, the light source and the output intensity adjustment mechanism, the controller operable to control a supply of electrical power from the power supply to the light source such that the light source illuminates in accordance with the output intensity set by the user;

a timer coupled to the controller and operable to determine an amount of time that the light source has been illuminated; and a memory coupled to the controller and operable to store a value representing a cumulative amount of time that the light source has been illuminated and at least one lumen depreciation curve indicating an estimated variation in output intensity of the light source over time;

wherein the controller is further operable to:

adjust the supply of electrical power from the power supply to the light source based on the stored value representing the cumulative amount of time that the light source has been illuminated and the at least one lumen depreciation curve.

8. The lighting unit of claim 7, wherein the controller is operable to adjust the supply of electrical power to the light source by increasing the supply of electrical power when the stored value representing the cumulative amount of time that the light source has been illuminated corresponds to a point on the at least one lumen depreciation curve indicating that an output intensity of the light source has decreased.

9. A self-contained, replaceable lighting unit with user-settable output intensity designed for use in a light fixture, the lighting unit comprising:

a power supply;

a light source;

at least one magnetic field source and at least one magnetic field detector configured to allow a user to set an output intensity of a plurality of non-zero output intensities generatable by the light source; and a controller operably coupled to the power supply, the light source and the at least one magnetic field detector, wherein the controller is operable to control a supply of electrical power from the power supply to the light source such that the light source illuminates in accordance with the output intensity set by the user based on detection of at least one magnetic field by the at least one magnetic field detector.

10. The lighting unit of claim 9, wherein the at least one magnetic field source comprises at least one magnet.

11. The lighting unit of claim 10, further comprising:

at least one printed circuit board supporting the power supply, the controller, and the at least one magnetic field detector;

a hollow, generally cylindrical base member defining, in an outer surface thereof, at least one channel extending along at least a portion of a length of the base member, the at least one channel terminating at one end in at least one wall defining at least one wall aperture;

a support plate;

at least one magnetizable fastener insertable through the at least one wall aperture for fastening at least the base member to the support plate; and a generally circular ring member including at least one socket projecting toward a center of a circle defined by the ring member, the at least one socket being configured to fit within the at least one channel of the base member and defining a recess for retaining the at least one magnet, wherein the at least one magnetic field detector is positioned on the at least one printed circuit board so as to be proximate the at least one fastener when the at least one fastener is fastened to the support plate, and wherein positioning of the ring member about the base member such that the at least one socket resides within the at least one channel and is in contact with the at least one fastener magnetizes the at least one fastener to produce the at least one magnetic field detectable by the at least one magnetic field detector.

12. The lighting unit of claim 9, wherein the at least one magnetic field detector comprises at least one Hall effect sensor.

13. A self-contained, replaceable lighting unit with user-settable output intensity designed for use in a light fixture, the lighting unit comprising:

a power supply;

a light source;

an output intensity adjustment mechanism configured to allow a user to set an output intensity of a plurality of non-zero output intensities generatable by the light source;

a controller operably coupled to the power supply, the light source and the output intensity adjustment mechanism, the controller operable to control a supply of electrical power from the power supply to the light source such that the light source illuminates in accordance with the output intensity set by the user;

a timer coupled to the controller and operable to determine an amount of time that the light source has been illuminated; and a memory coupled to the controller and operable to store a value representing a cumulative amount of time that the light source has been illuminated;

wherein the controller is further operable to:

update the value stored in the memory based on the amount of time determined by the timer;

determine whether a reporting time interval has arrived; and when the reporting time interval has arrived, modulate the supply of electrical power from the power supply to the light source so as to cause the light source to optically communicate an information signal therefrom, the information signal including the value stored in the memory and being visually undetectable by the user.

14. The lighting unit of claim 13, wherein the controller is operable to determine whether a reporting time interval has arrived based on whether the value stored in the memory is greater than or equal to a threshold.

15. The lighting unit of claim 13, wherein the controller is operable to periodically determine reporting time intervals.

16. A self-contained, replaceable lighting unit with user-settable output intensity designed for use in a light fixture, the lighting unit comprising:

a power supply;

a plurality of light emitting diodes (LEDs), each LED including a lens;

a light concentrating lens element defining a plurality of generally conical light-concentrating members, each light-concentrating member being positioned in substantial registry with a corresponding LED and defining a receiving recess, the receiving recess receiving the lens of the corresponding LED;

a hollow, generally cylindrical base member defining, in an outer surface thereof, at least one channel extending along at least a portion of a length of the base member, the at least one channel terminating at one end in at least one wall defining at least one wall aperture;

a support plate;

at least one magnetizable fastener insertable through the at least one wall aperture for fastening at least the base member to the support plate;

a generally circular ring member including at least one socket projecting toward a center of a circle defined by the ring member, the at least one socket being configured to fit within the at least one channel of the base member and defining a recess for retaining at least one magnet, the ring member being positionable about the base member such that the at least one socket resides within the at least one channel and is in contact with the at least one fastener, wherein contact between the at least one magnet and the at least one fastener magnetizes the at least one fastener to produce at least one magnetic field;

at least one magnetic field detector positioned proximate the at least one fastener when the at least one fastener is fastened to the support plate; and a controller operably coupled to the power supply, the plurality of LEDs and the at least one magnetic field detector, the controller operable to:

determine an output intensity setting for the lighting unit based on whether the at least one magnetic field is detected by the at least one magnetic field detector, and control a supply of electrical power from the power supply to the plurality of LEDs such that the plurality of LEDs illuminate in accordance with the output intensity setting.

17. The lighting unit of claim 16, further comprising:

at least a first printed circuit board supporting at least the controller;

a second printed circuit board supporting the plurality of LEDs and being separated from the at least a first printed circuit board, the second printed circuit board defining a wire pass-through aperture and including a set of solder pads;

a set of wires electrically connecting the at least a first printed circuit board and the set of solder pads, the set of wires passing through the wire pass-through aperture and being soldered to the solder pads, the solder pads being electrically coupled to the plurality of LEDs; and a fire-retardant, non-metallic shield member secured to the second printed circuit board and positioned between the second printed circuit board and the light concentrating lens element, the shield member defining a cavity that substantially encloses the set of wires and the set of solder pads, the shield member further defining a plurality of LED lens apertures, each LED lens aperture being substantially in registry with a respective receiving recess of the plurality of light-concentrating members such that the lens of an LED passes through a lens aperture of the shield member and into a respective receiving recess of a light-concentrating member.

18. A method for a lighting unit to optically report usage information from a light source of the lighting unit, the method comprising:

determining a cumulative amount of time that the light source has been illuminated;

determining whether a reporting time interval has arrived; and when a reporting time interval has arrived, using the light source to generate an optical, visually undetectable information signal that includes a value representing the cumulative amount of time that the light source has been illuminated.

19. The method of claim 18, wherein the step of determining whether a reporting time interval has arrived comprises:

determining whether a reporting time interval has arrived based on whether the cumulative amount of time that the light source has been illuminated is greater than or equal to a threshold.

20. The method of claim 18, wherein the step of determining whether a reporting time interval has arrived comprises:

determining whether a predetermined amount of time has passed since a previous reporting time interval.

21. A method for maintaining an output intensity for a lighting unit utilizing a plurality of light emitting diodes (LEDs), the method comprising:

storing at least one lumen depreciation curve for the plurality of LEDs, the at least one lumen depreciation curve indicating an estimated variation in output intensity of the plurality of LEDs over time;

determining a cumulative amount of time that the plurality of LEDs have been illuminated; and adjusting a supply of electrical power to the plurality of LEDs based on the cumulative amount of time that the plurality of LEDs have been illuminated and the at least one lumen depreciation curve.

22. The method of claim 21, wherein the step of adjusting a supply of electrical power to the plurality of LEDs comprises:

increasing the supply of electrical power to the plurality of LEDs when the cumulative amount of time that the plurality of LEDs have been illuminated corresponds to a point on the at least one lumen depreciation curve indicating that an output intensity of the plurality of LEDs has decreased.

23. A self-contained, replaceable lighting unit designed for use in a light fixture, the lighting unit comprising:

a power supply;

a light source that includes at least one lens;

a controller operably coupled to the power supply and the light source, the controller operable to control a supply of electrical power from the power supply to the light source such that the light source illuminates to a set output intensity;

at least one light-concentrating member positioned in substantial registry with the light source and defining at least one receiving recess, the at least one receiving recess receiving the at least one lens of the light source;

at least a first printed circuit board supporting at least the controller;

a second printed circuit board supporting the light source and being separated from the at least a first printed circuit board, the second printed circuit board defining a wire pass-through aperture and including a set of solder pads;

a set of wires electrically connecting the at least a first printed circuit board and the set of solder pads, the set of wires passing through the wire pass-through aperture and being soldered to the solder pads, the solder pads being electrically coupled to the light source; and a non-metallic shield member secured to the second printed circuit board and positioned between the second printed circuit board and the at least one light-concentrating member, the shield member defining a cavity that encloses the set of wires and the set of solder pads.

24. The lighting unit of claim 23, wherein the light source comprises at least one light emitting diode (LED).

25. The lighting unit of claim 23, wherein the shield member has a UL 94-V5 fire rating.

26. The lighting unit of claim 25, wherein the lighting unit has a UL 94-V5 fire rating.

27. The lighting unit of claim 23, wherein the shield member further defines at least one lens aperture and wherein the at least one lens aperture is substantially in registry with the at least one receiving recess of the at least one light-concentrating member such that the at least one lens of the light source passes through the at least one lens aperture of the shield member and into the at least one receiving recess of the at least one light-concentrating member.

28. A self-contained, replaceable lighting unit designed for use in a light fixture, the lighting unit comprising:

a power supply;

a light source;

a timer operable to determine an amount of time that the light source has been illuminated;

a memory operable to store a value representing a cumulative amount of time that the light source has been illuminated and at least one lumen depreciation curve indicating an estimated variation in output intensity of the light source over time; and a controller operably coupled to the power supply, the light source, the timer and the memory, the controller operable to adjust a supply of electrical power from the power supply to the light source based on the at least one lumen depreciation curve and the stored value representing the cumulative amount of time that the light source has been illuminated.

29. The lighting unit of claim 28, wherein the controller is operable to adjust the supply of electrical power to the light source by increasing the supply of electrical power when the stored value representing the cumulative amount of time that the light source has been illuminated corresponds to a point on the at least one lumen depreciation curve indicating that an output intensity of the light source has decreased.

30. The lighting unit of claim 28, wherein the light source comprises at least one light emitting diode (LED).

31. A self-contained, replaceable lighting unit designed for use in a light fixture, the lighting unit comprising:

a power supply;

a light source;

a timer operable to determine an amount of time that the light source has been illuminated; and a memory operable to store a value representing a cumulative amount of time that the light source has been illuminated;

a controller operably coupled to the power supply, the light source, the timer and the memory, the controller operable to:

update the value stored in the memory based on the amount of time determined by the timer;

determine whether a reporting time interval has arrived; and when the reporting time interval has arrived, modulate the supply of electrical power from the power supply to the light source so as to cause the light source to optically communicate an information signal therefrom, the information signal including the value stored in the memory and being visually undetectable by a user of the lighting unit.

32. The lighting unit of claim 31, wherein the controller is operable to determine whether a reporting time interval has arrived based on whether the value stored in the memory is greater than or equal to a threshold.

33. The lighting unit of claim 31, wherein the controller is operable to periodically determine reporting time intervals.

34. The lighting unit of claim 31, wherein the light source comprises at least one light emitting diode (LED).

35. A method for maintaining an output intensity for a lighting unit utilizing a light source, the method comprising:

storing at least one lumen depreciation curve for the light source, the at least one lumen depreciation curve indicating an estimated variation in output intensity of the light source over time;

determining a cumulative amount of time that the light source has been illuminated; and adjusting a supply of electrical power to the light source based on the cumulative amount of time that the light source has been illuminated and the at least one lumen depreciation curve.

36. The method of claim 35, wherein the step of adjusting a supply of electrical power to the light source comprises:

increasing the supply of electrical power to the light source when the cumulative amount of time that the light source has been illuminated corresponds to a point on the at least one lumen depreciation curve indicating that an output intensity of the light source has decreased.

* * * * *